US011958092B2

(12) United States Patent
Yamashita et al.

(10) Patent No.: US 11,958,092 B2
(45) Date of Patent: Apr. 16, 2024

(54) PRODUCTION METHOD FOR HAT-SHAPED STEEL SHEET PILE

(71) Applicant: NIPPON STEEL CORPORATION, Tokyo (JP)

(72) Inventors: Hiroshi Yamashita, Tokyo (JP); Shinya Hayashi, Tokyo (JP); Masanori Kawai, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/799,888

(22) PCT Filed: Mar. 10, 2021

(86) PCT No.: PCT/JP2021/009617
§ 371 (c)(1),
(2) Date: Aug. 15, 2022

(87) PCT Pub. No.: WO2021/182528
PCT Pub. Date: Sep. 16, 2021

(65) Prior Publication Data

US 2023/0104109 A1 Apr. 6, 2023

(30) Foreign Application Priority Data

Mar. 10, 2020 (JP) ..... 2020-041315
Mar. 10, 2020 (JP) ..... 2020-041331

(51) Int. Cl.
*B21B 1/08* (2006.01)
*B21B 1/082* (2006.01)

(52) U.S. Cl.
CPC ..... *B21B 1/082* (2013.01)

(58) Field of Classification Search
CPC ..... B21B 1/14; B21B 1/082; B21B 1/088; B21B 13/06; B21B 2013/106; B21B 1/0886; B21B 1/095
See application file for complete search history.

(56) References Cited

U.S. PATENT DOCUMENTS 4,334,419 A * 6/1982 Kishikawa ..... B21B 1/082 72/225
10,751,772 B2 * 8/2020 Hashimoto ..... B21B 1/082
(Continued)

FOREIGN PATENT DOCUMENTS

JP 2003-230916 A 8/2003
JP 2007-237276 A 9/2007
JP 4464865 B2 5/2010

OTHER PUBLICATIONS

JP 10-192905A, Nagahiro Jul. 1998.*
JP 57-44414A, Miura Mar. 1982.*
JP 54-128467A, Kishikawa et al. Oct. 1979.*

*Primary Examiner* — Edward T Tolan
(74) *Attorney, Agent, or Firm* — Birch, Stewart, Kolasch & Birch, LLP

(57) ABSTRACT

There is provided a production method for a hat-shaped steel sheet pile including performing rough rolling, intermediate rolling, and finish rolling on a material to be rolled through hot rolling, and then performing bending forming, in which the material to be rolled is composed of a web corresponding part, flange corresponding parts, arm corresponding parts, and joint corresponding parts, corner parts as worked parts are formed at connection places between the web corresponding part and the flange corresponding parts and connection places between the flange corresponding parts and the arm corresponding parts, the intermediate rolling is carried out by performing rolling in a plurality of passes on the material to be rolled in a hot state by using a caliber
(Continued)

provided to upper and lower caliber rolls in one or a plurality of intermediate rolling mills in which one stand is configured by one caliber, at a height lower than a predetermined target product height, the bending forming is performed in a hot state and performed in a state where the worked parts have a temperature of transformation point or higher, and in the bending forming, the material to be rolled is formed to have predetermined target height and target width.

23 Claims, 14 Drawing Sheets

(56) References Cited

U.S. PATENT DOCUMENTS

| | | | | |
|---|---|---|---|---|
| 11,364,524 | B2 * | 6/2022 | Yamashita | B21B 1/088 |
| 2020/0269294 | A1 * | 8/2020 | Hayashi | B21B 1/14 |
| 2021/0370369 | A1 * | 12/2021 | Yamashita | B21B 1/082 |

* cited by examiner (a)

(b)

(c)

(a)

(b)

(c)

(d)

(a)

(b)

(c)

(d)

(a)

(b)

PRODUCTION METHOD FOR HAT-SHAPED STEEL SHEET PILE

TECHNICAL FIELD

Cross-Reference to Related Applications

This application is the National Phase of PCT International Application No. PCT/JP2021/009617, filed on Mar. 10, 2021, which claims priority under 35 U.S.C. 119(a) to Patent Application No. 2020-041315, filed in Japan on Mar. 10, 2020 and Patent Application No. 2020-041331, filed in Japan on Mar. 10, 2020, all of which are hereby expressly incorporated by reference into the present application.

The present invention relates to a production method for a hat-shaped steel sheet pile.

BACKGROUND ART

As a production method for a hat-shaped steel sheet pile, a method of performing rolling to a steel sheet pile to be a product through a hot-rolling method, is mainly employed, and Patent Document 1 and Patent Document 2 disclose production methods for a hat-shaped steel sheet pile and so on by using a general caliber rolling method. Conventionally, a hat-shaped steel sheet pile and so on have been produced through production steps disclosed in such publicly-known documents. Hereinafter, the prior art will be explained with reference to the drawings, based on these publicly-known documents.

For shaping of a hat-shaped steel sheet pile and so on, a so-called caliber rolling method is generally employed. FIG. 1 is a schematic explanatory view illustrating conventional general production steps for a hat-shaped steel sheet pile. As the production steps for a hat-shaped steel sheet pile, as illustrated in FIG. 1, a rectangular material, for example, is first heated to a predetermined temperature by a heating furnace, and thereafter, a rough rolling mill including a pair of double rolls configuring a caliber is used to produce a raw blank. Subsequently, from the raw blank, an intermediate material is formed by an intermediate rolling mill including pairs of double rolls each of which configures a caliber, and thereafter, a finish rolling mill including a pair of double rolls configuring a caliber is used to obtain a product having joints.

Further, FIG. 2(*a*) to FIG. 2(*f*) are explanatory views illustrating a shaping process of a step performed by a rough rolling mill and thereafter in conventional production of a hat-shaped steel sheet pile. Here, FIG. 2(*a*) to FIG. 2(*c*) illustrate steps performed by a rough rolling mill, FIG. 2(*d*) and FIG. 2(*e*) illustrate steps performed by an intermediate rolling mill, and FIG. 2(*f*) illustrates a step performed by a finish rolling mill. The aforementioned Patent Document 1 mainly describes a rolling method of an intermediate material, and the aforementioned Patent Document 2 describes a method of performing bending on joint parts of an intermediate material to perform bending and shaping of joints of a product.

As a rectangular material, bloom or a slab is generally used. In a step of forming the rectangular material into a raw blank, in a rough rolling mill in which two to three calibers are arranged, the rectangular material is sequentially rolled by the arranged calibers, whereby the raw blank is formed. Next, in an intermediate rolling mill in which four to five calibers in total are arranged, the raw blank is sequentially rolled by the arranged calibers, whereby an intermediate material is formed. Here, as illustrated in FIGS. 2, a left joint part and a right joint part have an asymmetric shape (they are symmetric about a point), and since a difference in height is large, a left arm part and a right arm part are inclined with respect to a horizontal direction as illustrated in FIG. 2(*e*) to align the heights of the left joint part and the right joint part, and a principal axis of inertia of a cross section is made to coincide with a reduction direction (an up-down direction in FIG. 2), to thereby suppress bending at a rolling outlet side.

Further, at a periphery of a root of a joint bottom, the joint part is bent to be shaped, whereby the joint is formed. Consequently, a product illustrated in FIG. 2(*f*) is shaped. In the conventional shaping method for a hat-shaped steel sheet pile explained above with reference to FIG. 1 and FIGS. 2, when shaping the product from the rectangular material, about 7 to 10 calibers are used, and working in about 30 passes in total is required.

Further, as disclosed in Patent Document 3, the prior art such that, with respect to a product shaped through a method as described above, cold working using a roll forming device having support rolls and the like (refer to FIG. 3) is performed to produce a hat-shaped steel sheet pile having a cross-sectional shape with different height or width, is also publicly known. [Prior Art Document][Patent Document]

Patent Document 1: Japanese Patent No. 4464865

Patent Document 2: Japanese Laid-open Patent Publication No. 2007-237276

Patent Document 3: Japanese Laid-open Patent Publication No. 2003-230916

DISCLOSURE OF THE INVENTION

Problems to be Solved by the Invention

As can be understood by referring to the aforementioned Patent Documents 1 to 3, as a production method for a hat-shaped steel sheet pile, the steps as illustrated in FIG. 1 to FIG. 3 are known. Here, in order to reduce a production cost in the shaping method according to the prior art, it is required to increase production efficiency and yield. Further, as a means for achieving that, it can be considered to reduce the number of calibers, for example. By the reduction in the number of calibers, it becomes possible to suppress a time loss according to handover of the material to be rolled (the rectangular material, the intermediate material, or the like) between the calibers, and a reduction in temperature of the material to be rolled due to heat release during the handover. Specifically, the production efficiency is improved, and besides, the reduction in temperature of the material to be rolled is suppressed, which enables to extend a length of rolling elongation, reduce a cut-off ratio of a rolling failure part of front and rear end parts of the material to be rolled, and improve the yield.

On the other hand, the reduction in the number of calibers means that a reduction amount per caliber and the drawing in each caliber are increased. However, due to reasons such that the strength of a pair of double rolls configuring a caliber is limited, and an output of a rolling mill for driving the pair of double rolls is restricted, it is difficult to apply a large reduction amount or perform drawing with respect to the material to be rolled in one pass (half-reciprocation in caliber). Accordingly, it is required to obtain desired drawing (normally 1.8 or more) by performing multiple-pass reverse rolling (also called caliber multiple-pass rolling, hereinafter) in two passes or more in one caliber.

Generally, a shape steel such as a hat-shaped steel sheet pile has a sheet thickness distribution in a width direction, and in order to roll such a shape steel by using a caliber provided to a pair of double rolls, only one pass of rolling is performed in each caliber, which is a basic knowledge, and thus conventionally, the caliber multiple-pass rolling is not performed except for rolling using a rough rolling mill (which is called rough rolling, hereinafter) and the beginning of rolling using an intermediate rolling mill (which is called intermediate rolling, hereinafter). This is because, by performing the caliber multiple-pass rolling, insufficient filling of metal (material to be rolled) into a caliber (which is called thickness decrease, hereinafter), an overflow of metal from the caliber (which is called biting-out, hereinafter), and bending of the material to be rolled are induced. In a case of the hat-shaped steel sheet pile, these appear as twist as illustrated in FIG. 20(*a*), and bending in an up-down direction such as waving of a flange part as illustrated in FIG. 20(*b*). Note that the reason why a certain level of caliber multiple-pass rolling can be performed in the rough rolling and at the beginning of the intermediate rolling, is because the sheet thickness of the material to be rolled is relatively large, so that the rigidity is high, which makes it difficult to cause the twist, the waving, and the bending, and even in a case where the thickness decrease or the biting-out occurs, if it is a relatively slight one, it can be eliminated by rolling in a succeeding caliber.

In a hat-shaped steel sheet pile, a flange part is sandwiched by a web part and an arm part from its both sides, so that elongation and width extension of the flange part are suppressed to prevent the biting-out from occurring in the flange part, but instead of this, a compressive stress is likely to occur in the flange part, and when this compressive stress exceeds a buckling limit stress, buckling occurs to cause the waving (which is called a flange wave, hereinafter). On the contrary, when the thickness decrease occurs in the flange part, a surface of the flange part is separated from a roll, resulting in that the roll cannot restrain the flange part, which causes the twist.

Specifically, in a case where the hat-shaped steel sheet pile is subjected to a plurality of times of rolling (multiple-pass rolling) by using a plurality of calibers, reduction is not performed equally on the flange part and the web part of the hat-shaped steel sheet pile, which is a problem. As illustrated in FIG. 4, the web part of the hat-shaped steel sheet pile has a horizontal shape, and is repeatedly subjected to reduction in that state from the up-down direction. For this reason, when the web part and the flange part are subjected to reduction at the same reduction amount in a roll gap direction, actual drawing of the flange part $(tf+\Delta F)/tf$ was smaller than actual drawing of the web part $(tw+\Delta W)/tw$. Therefore, it is impossible to perform reduction on the web part and the flange part in multiple passes in the same caliber while changing the roll gap to be small to realize the same drawing of the web part and the flange part, and if the multiple-pass rolling is forced to be performed, a rolling wave occurs or a line length within a cross section changes greatly, so that it has been difficult to stably perform the rolling.

Further, in the aforementioned Patent Document 3, in particular, a rolling stand for performing hot rolling and a stand for performing cold working through roll forming are configured in an off-line manner, which means that a steel sheet pile being a product is not produced continuously, and thus there was room for improvement in production efficiency of the steel sheet pile. Concretely, in the cold working through roll forming, since a steel material temperature is low, springback during the working becomes large, and it is required to apply a large strain to the steel material in a cold state. Further, when the temperature during the working is low, deterioration of material quality such as a reduction in toughness is concerned. FIG. 21 is an explanatory view regarding a shape change in bending forming in cold working, and is a graph illustrating an overall width variation in a longitudinal direction of a material (steel material) after performing bending forming in a cold state as disclosed in Patent Document 3 on the material (steel material) with no overall width variation in the longitudinal direction. As illustrated in FIG. 21, in the bending forming in the cold state, a forming effect of an end part in the longitudinal direction, in particular, is smaller than that of a steady part, and in the end part, insufficient bending is likely to occur, and the overall width is increased. For this reason, reworking or cutting-off may be required, and thus the reduction in yield and productivity is concerned.

Accordingly, in view of the above-described problems, the present invention has an object to provide a production method for a steel sheet pile in which rolling is performed, in intermediate to finish rolling, by a rolling stand in which only one caliber is provided for one rolling stand, at a height lower than a desired height of a steel sheet pile product, and then bending forming is performed in an on-line manner to obtain a steel sheet pile product with the desired height, and improvement in production efficiency, a reduction in rolling time, and cost reduction are realized.

In addition, the present invention has an object to provide a production method for a steel sheet pile capable of stably performing caliber multiple-pass rolling in intermediate rolling of production of a steel sheet pile by realizing prevention of a flange wave and prevention of twist in the rolling.

Means for Solving the Problems

In order to solve the above-described problems, according to the present invention, there is provided a production method for a hat-shaped steel sheet pile including performing rough rolling, intermediate rolling, and finish rolling on a material to be rolled through hot rolling, and then performing bending forming, in which the material to be rolled is composed of a web corresponding part, flange corresponding parts, arm corresponding parts, and joint corresponding parts, corner parts as worked parts are formed at connection places between the web corresponding part and the flange corresponding parts and connection places between the flange corresponding parts and the arm corresponding parts, the intermediate rolling is carried out by performing rolling in a plurality of passes on the material to be rolled in a hot state by using a caliber provided to upper and lower caliber rolls in one or a plurality of intermediate rolling mills in which one stand is configured by one caliber, at a height lower than a predetermined target product height, the bending forming is performed in a hot state and performed in a state where the worked parts have a temperature of transformation point or higher, and in the bending forming, the material to be rolled is formed to have predetermined target height and target width.

Effect of the Invention

According to the present invention, rolling is performed, in intermediate rolling to finish rolling, by a rolling stand in which only one caliber is provided for one stand, at a height lower than a desired height of a steel sheet pile product, and then bending forming is performed in an on-line manner to obtain a steel sheet pile product with the desired height, and improvement in production efficiency, a reduction in rolling time, and cost reduction are realized. Further, in intermediate rolling of production of a steel sheet pile, it is possible to stably perform caliber multiple-pass rolling by realizing prevention of a flange wave and prevention of twist in the rolling.

EMBODIMENTS FOR CARRYING OUT THE INVENTION

Figure 1:
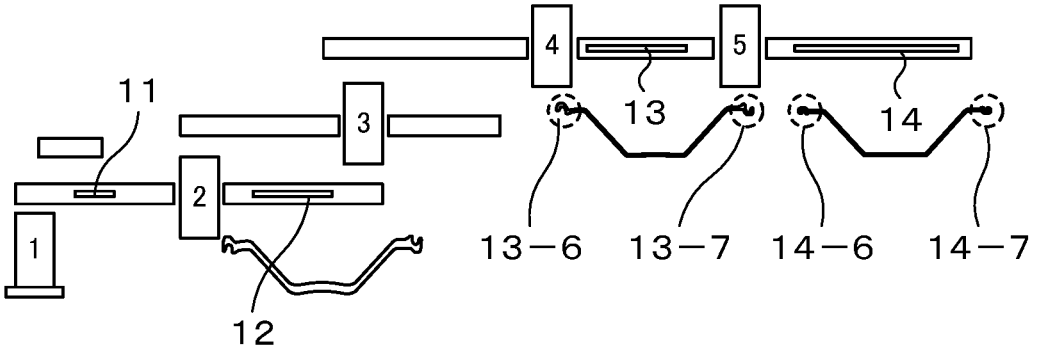
FIG. 1 is a schematic explanatory view illustrating general production steps of a hat-shaped steel sheet pile.
Figure 2:
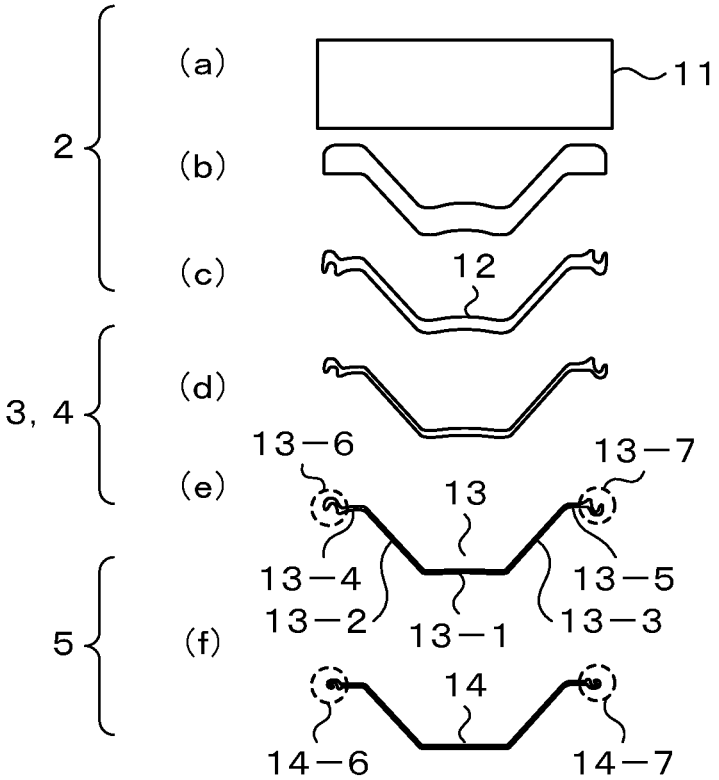
FIG. 2 is an explanatory view illustrating a shaping process of a step performed by a rough rolling mill and thereafter in conventional production of a hat-shaped steel sheet pile.
Figure 3:
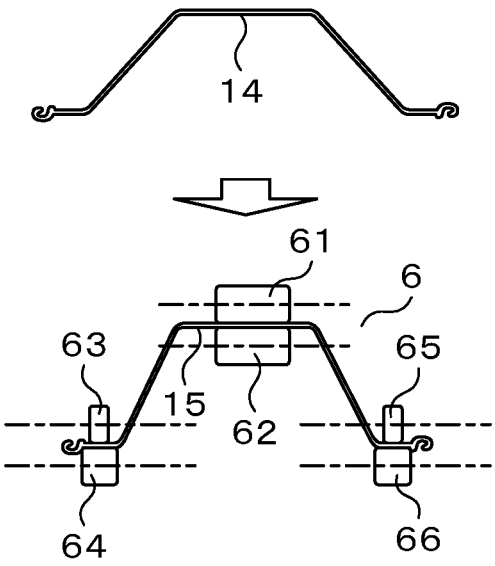
FIG. 3 is an explanatory view of prior art in which a hat-shaped steel sheet pile having a cross-sectional shape with different height or width is produced through cold working by using a roll forming device.
Figure 4:
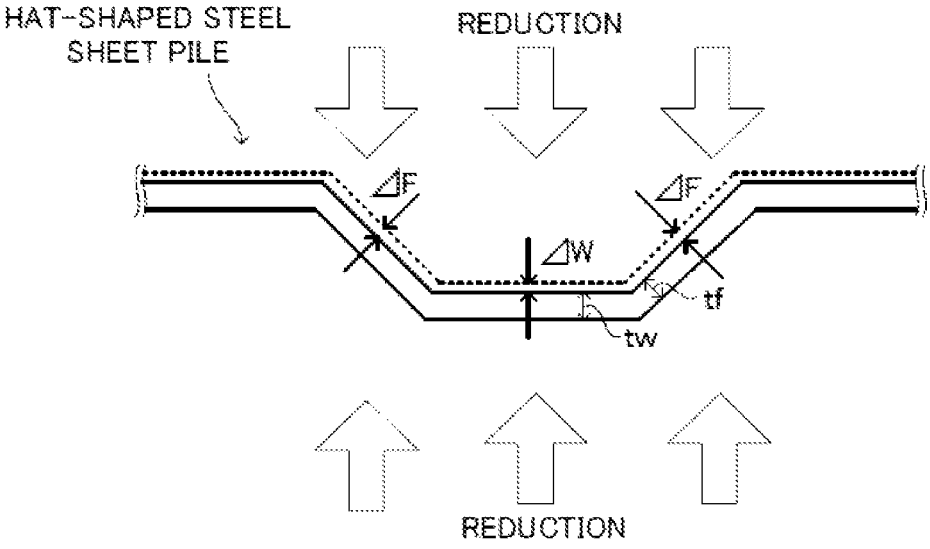
FIG. 4 is an explanatory view regarding a relationship between a flange reduction amount ΔF and a web reduction amount ΔW in a hat-shaped steel sheet pile.

Hereinafter, an embodiment of the present invention will be explained while referring to the drawings. Note that, in this description and the drawings, the same codes are given to components having substantially the same functional configurations to omit duplicated explanation. Note that in the present embodiment, explanation will be made on a case where a hat-shaped steel sheet pile is produced as a steel sheet pile product.

(Configuration of Rolling Line)

Figure 5:
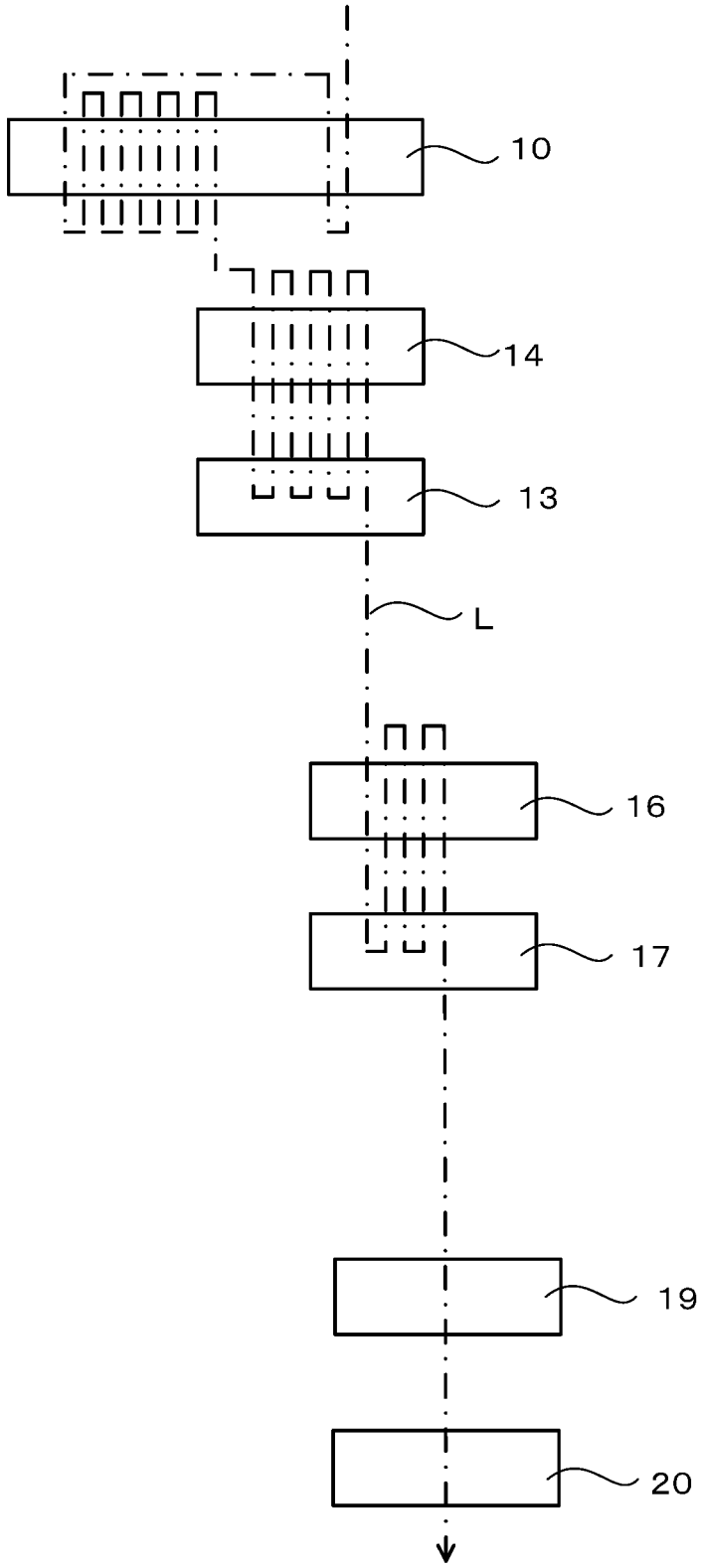
FIG. 5 is a schematic explanatory view of a rolling line according to an embodiment of the present invention.

FIG. 5 is an explanatory view of a rolling line L (indicated by a dot and dash line in the drawing) for producing the hat-shaped steel sheet pile according to the embodiment of the present invention, rolling mills provided on the rolling line L, and so on. Note that in FIG. 5, a rolling forward direction of the rolling line L is a direction indicated with an arrow mark, a material to be rolled flows in the direction, rolling and bending forming are performed in respective rolling mills and a bending forming machine on the line to shape a product. Further, in FIG. 5, a rolling method in which the material to be rolled is reciprocated a plurality of times in the same rolling mill (so-called multiple-pass rolling) is also illustrated by a dot and dash line.

As illustrated in FIG. 5, on the rolling line L, a rough rolling mill 10, a first intermediate rolling mill 13, a second intermediate rolling mill 16, a finish rolling mill 19, and a bending forming machine 20 are arranged in order from the upstream side. Further, on the upstream side of the first intermediate rolling mill 13, an edger rolling mill 14 is arranged in an adjacent manner, and on the downstream side of the second intermediate rolling mill 16, an edger rolling mill 17 is arranged in an adjacent manner.

On the rolling line L, a rectangular material (material to be rolled) heated in a not-illustrated heating furnace is rolled in a hot state in sequence in the rough rolling mill 10 to the finish rolling mill 19, and further formed in a hot state in the bending forming machine 20, to be formed into a final product. Note that hereinafter, for the sake of explanation, the material to be rolled rolled in the rough rolling mill 10 is also called a raw blank, the material to be rolled rolled in the first intermediate rolling mill 13 to the second intermediate rolling mill 16 is also called an intermediate material, and the material to be rolled rolled in the finish rolling mill 19 is also called a finished material 19*a*. Specifically, one obtained by forming (changing a cross section of) the finished material 19*a* by using the bending forming machine 20, becomes the final product (namely, the hat-shaped steel sheet pile product).

Here, the rough rolling mill 10, the first intermediate rolling mill 13, the second intermediate rolling mill 16, the finish rolling mill 19, and the edger rolling mills 14, 17 arranged in an accompanied manner, which are arranged on the rolling line L are general pieces of equipment conventionally used in production of a steel sheet pile, so that explanation regarding detailed device configurations and so on thereof will be omitted in the present embodiment.

(Configuration of Bending Forming Machine)

Figure 6:
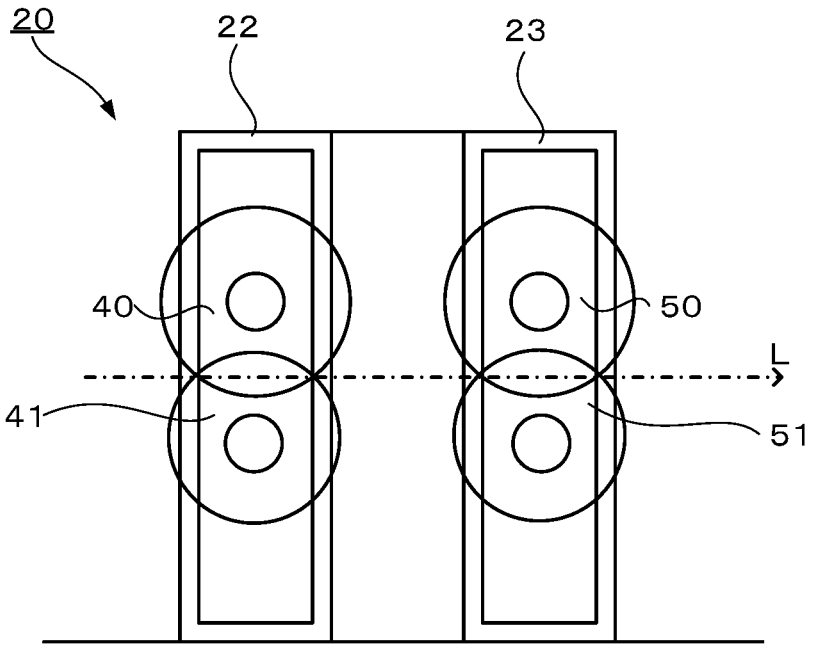
FIG. 6 is a schematic side sectional view of a bending forming machine.
Figure 7:
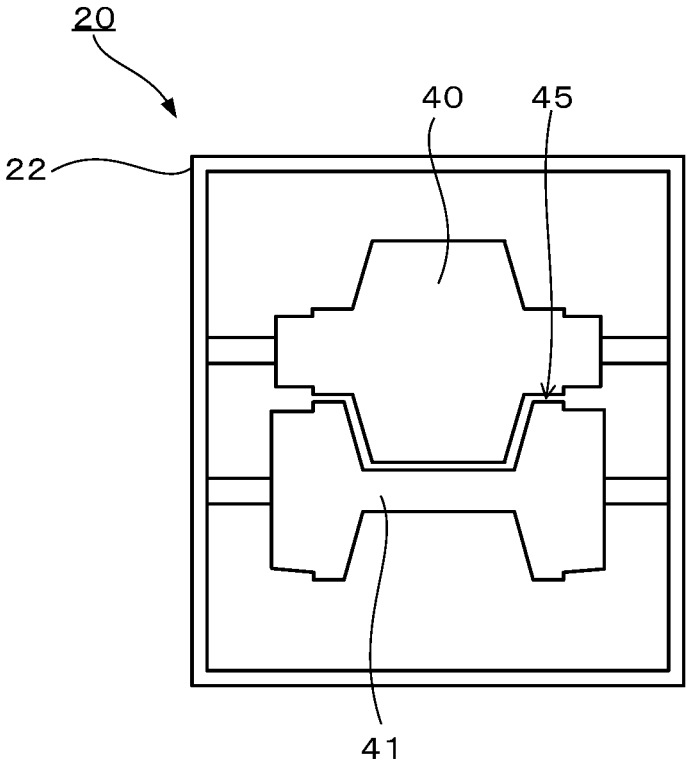
FIG. 7 is a schematic front view of the bending forming machine.

Next, a detailed configuration of the bending forming machine 20 will be described with reference to the drawings. FIG. 6 is a schematic side sectional view of the bending forming machine 20, and FIG. 7 is a schematic front view of the bending forming machine 20. The bending forming machine illustrated in FIG. 6 and FIG. 7 performs bending (bending forming) on the finished material 19*a* after being subjected to finish rolling in the finish rolling mill 19. Note that FIG. 7 illustrates a schematic front view of a first stand 22 provided to the bending forming machine 20 to be explained hereinbelow. Here, in the present embodiment, explanation is made by exemplifying a case where the bending forming machine 20 is configured by two forming stands (forming stands 22, 23 to be explained hereinbelow), but the bending forming machine 20 may also be configured by a single stand or arbitrary plural stands.

As illustrated in FIG. 6, the bending forming machine 20 according to the present embodiment includes the two forming stands 22, 23 (also called an upstream-side first stand 22 and a downstream-side second stand 23, hereinafter) which are adjacently arranged in series. Further, as illustrated in FIG. 7, the respective stands 22, 23 are provided with forming calibers (calibers 44, 55 to be described later), respectively, each of which is configured by an upper caliber roll and a lower caliber roll, and a caliber shape in the first stand 22 and a caliber shape in the second stand 23 are different from each other.

Figure 8:
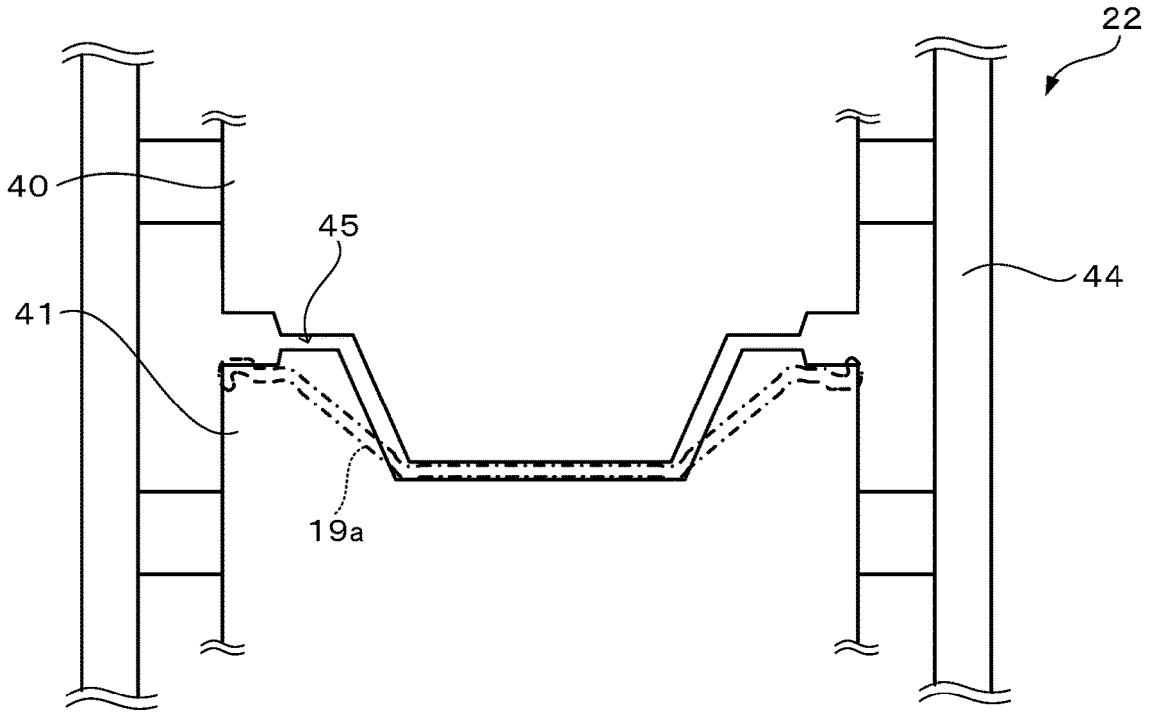
FIG. 8 is a schematic enlarged front view illustrating a caliber shape of a first stand.
Figure 9:
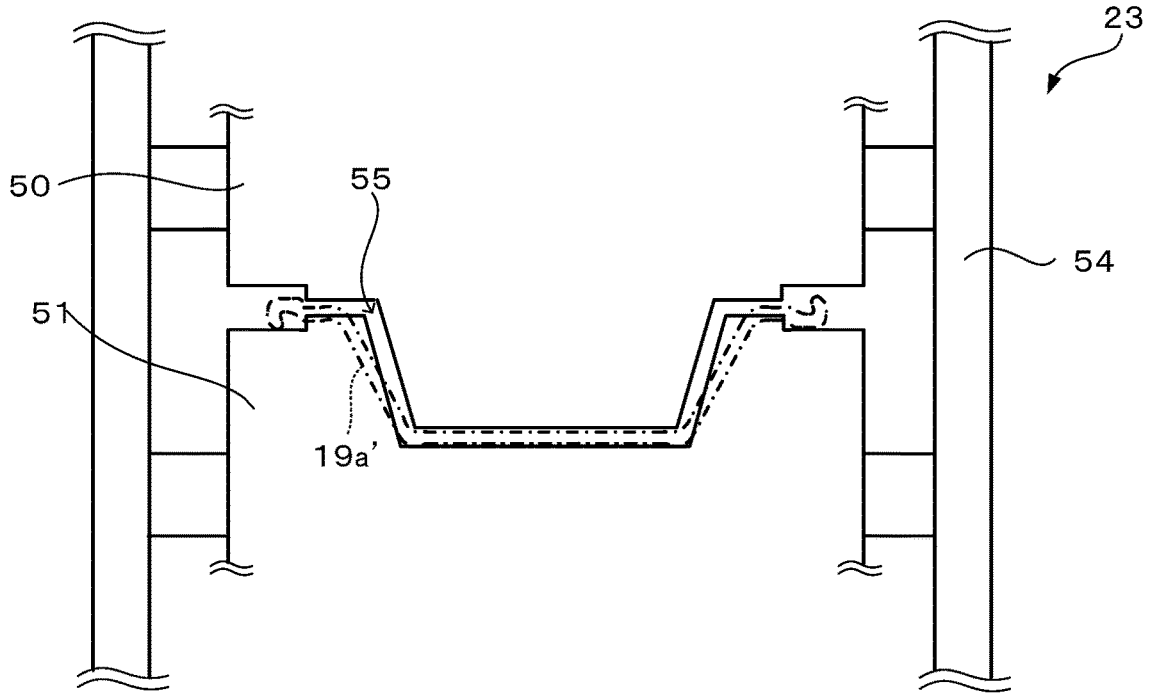
FIG. 9 is a schematic enlarged front view illustrating a caliber shape of a second stand.

Here, the roll configuration and the caliber shape of each of the first stand 22 and the second stand 23 will be explained. FIG. 8 is a schematic enlarged front view illustrating the caliber shape of the first stand 22, and FIG. 9 is a schematic enlarged front view illustrating the caliber shape of the second stand 23. Note that in FIG. 8, a shape of a cross section of the finished material 19*a* before being subjected to the forming by the bending forming machine 20 is illustrated by a dot and dash line, and in FIG. 9, a shape of a cross section of a finished material 19*a*' before being subjected to the forming by the second stand 23 is illustrated by a dot and dash line. Further, hereinafter, explanation will be made by exemplifying a case where the bending forming is performed on the material to be rolled in a substantially hat shape, in a posture of upward-opening (a later-described web corresponding part is positioned downward, and arm corresponding parts are positioned upward).

As illustrated in FIG. 7 and FIG. 8, in the first stand 22, an upper caliber roll 40 and a lower caliber roll 41 are provided by being supported by a casing 44, and the upper caliber roll 40 and the lower caliber roll 41 configure the caliber 45. In this caliber 45, a shape from a portion corresponding to a flange to a portion corresponding to a joint is a shape of right before obtaining the hat-shaped steel sheet pile product (namely, a substantially hat-shaped steel sheet pile product shape). The caliber 45 changes each of an angle made by a portion corresponding to a flange (namely, a flange corresponding part) of the finished material 19*a* and a portion corresponding to a web (namely, a web corresponding part) of the finished material 19*a*, and an angle made by the flange corresponding part and a portion corresponding to an arm (namely, an arm corresponding part) of the finished material 19*a*, to perform bending on the finished material 19*a* to have a predetermined shape of a height and a width (namely, a cross-sectional shape close to that of a product). In particular, when the hat-shaped steel sheet pile is produced, a method is employed such that the material to be rolled (from the raw blank to the finished material 19*a*) is rolled at a height-reduced shape in the rough rolling mill 10 to the finish rolling mill 19, and the bending is performed in the bending forming machine to increase the height of the material to be rolled to a desired product height. This makes it possible to produce a large-sized hat-shaped steel sheet pile product.

Further, as illustrated in FIG. 9, in the second stand 23, an upper caliber roll 50 and a lower caliber roll 51 are provided by being supported by a casing 54, and the upper caliber roll 50 and the lower caliber roll 51 configure the caliber 55. This caliber 55 has a shape close to a desired product shape, and changes each of an angle made by the portion corresponding to the flange (namely, the flange corresponding part) formed by the first stand 22 of the bending forming machine 20 and the portion corresponding to the web (namely, the web corresponding part) of the finished material 19*a*, and an angle made by the flange corresponding part and the portion corresponding to the arm (namely, the arm corresponding part), to perform forming to make the flange shape, the arm shape, and the joint shape to be predetermined shapes (namely, the product shape). Specifically, this second stand 23 performs forming to change an inclination angle of the flange corresponding part which is insufficient with respect to the product shape in the forming in the first stand 22, to an angle according to the product shape.

(Roll Gap During Bending Forming)

Here, a roll gap in each of the aforementioned caliber 45 and caliber 55 (a roll gap between the upper caliber roll 40 and the lower caliber roll 41 and a roll gap between the upper caliber roll 50 and the lower caliber roll 51) during the bending forming is configured to be larger than thicknesses of the flange corresponding part and the web corresponding part of the finished material 19*a*. Specifically, in the bending forming machine 20, a sheet thickness reduction of the finished material 19*a* is not performed, and it is configured such that the respective caliber rolls of the first stand 22 and the second stand 23 and the finished material 19*a* are brought into contact only at part of predetermined places to be described later to perform the bending forming.

Further, as will be described later, during the bending forming, the respective caliber rolls of the first stand 22 and the second stand 23 and the finished material 19*a* are brought into contact, and may be further subjected to reduction at part of predetermined places. The "contact" in this description means a state where, in the bending forming machine 20, only either an upper surface or a lower surface at a specific place of the finished material 19*a* abuts against a peripheral surface of the caliber roll. On the contrary, the "reduction" means a state where, in the bending forming machine 20, both the upper surface and the lower surface at the specific place of the finished material 19*a* abut against the caliber rolls, and force is applied to the surfaces so as to reduce the thickness.

For example, the aforementioned roll gaps at portions facing the web corresponding part and the flange corresponding part are preferably larger by about 0.5 mm to 3 mm than the thicknesses of the flange corresponding part and the web corresponding part of the finished material 19*a*. Besides, also at a place corresponding to the arm corresponding part of the finished material 19*a* in each of the aforementioned caliber 45 and caliber 55, a roll gap at the place may also be configured to be larger than the thickness of the arm corresponding part over the whole cross section. When an allowance range of the aforementioned roll gap is smaller than 0.5 mm, there is a possibility that the thickness is reduced due to a variation in sheet thickness of the finished material 19*a* to increase a load of the bending forming machine 20, and when it is larger than 3 mm, there is a possibility that the inclination angle of the flange corresponding part cannot be made to a target angle.

Figure 10:
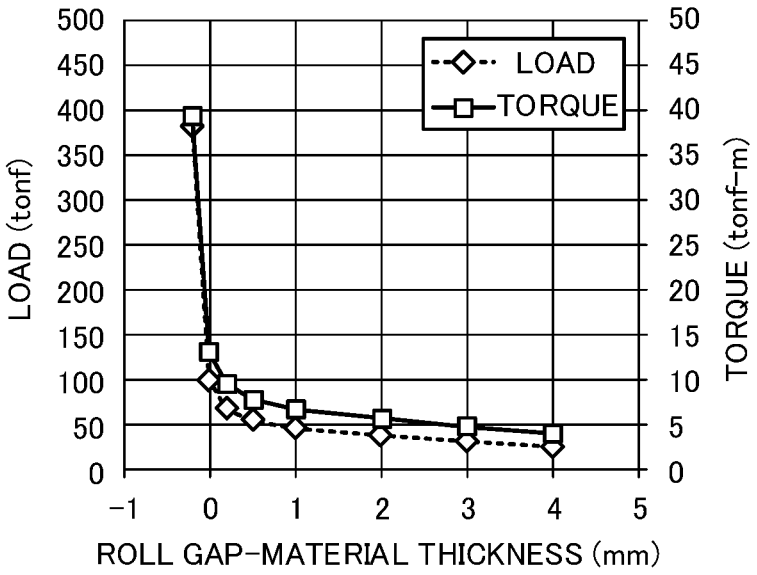
FIG. 10 is a graph illustrating a relation between "roll gap-thickness of material to be rolled" and "load" during bending forming.

Here, the present inventors conducted further detailed studies regarding the allowance range of the roll gaps at the portions facing the web corresponding part and the flange corresponding part, and a forming machine load characteristic (change in load and torque) and formability (accuracy of bending angle). FIG. 10 is a graph illustrating a relation between "roll gap-material thickness (namely, an allowance value of the roll gap)" when performing the bending forming on the finished material 19*a* and "load and torque" applied to the bending forming machine 20. Further, FIG. 11 is a graph illustrating a relation between "roll gap-material thickness (namely, the allowance value of the roll gap)" when performing the bending forming on the finished material 19*a* and "angle between web and flange" after the bending forming.

Figure 11:
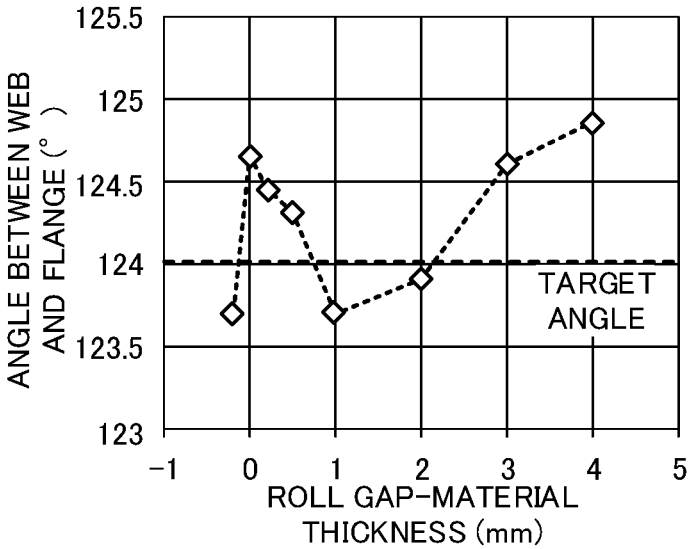
FIG. 11 is a graph illustrating a relation between "roll gap-thickness of material to be rolled" and "angle between web and flange" during bending forming.
Figure 12:
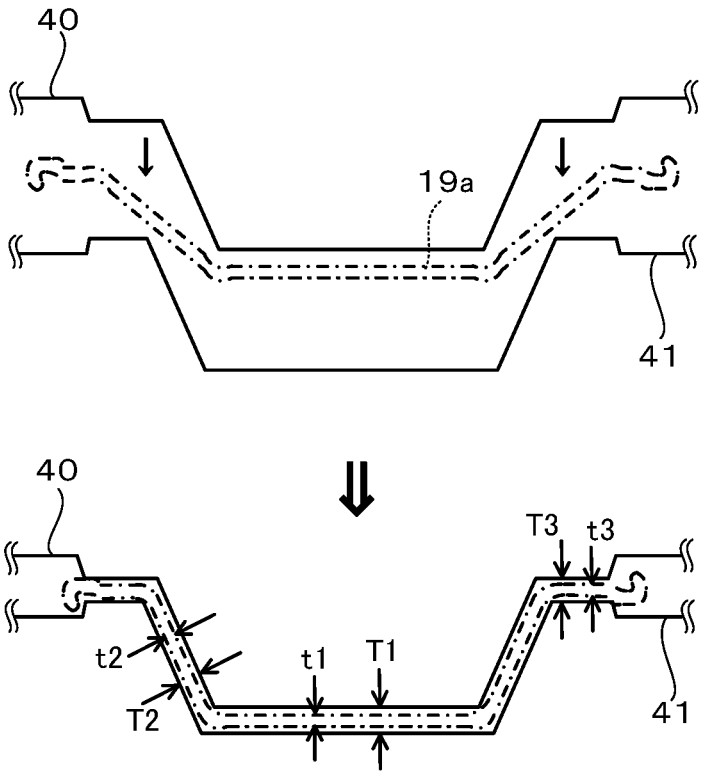
FIG. 12 is a schematic explanatory view illustrating a dimensional relation during bending forming.

Note that each of the graphs in FIG. 10 and FIG. 11 illustrates a case where the finished material 19*a* after being subjected to the finish rolling having a substantially hat-shaped steel sheet pile shape with dimensional conditions of a width of 1400 mm, a web thickness of 14.7 mm, a flange thickness of 11.4 mm, and a flange angle of 400 (an angle between web and flange of 140°) is subjected to bending forming in the first stand 22 to obtain a flange angle of 56° (an angle between web and flange of 124°) as a target. FIG. 12 is a schematic explanatory view illustrating a dimensional relation when performing the bending forming in the first stand 22. The studies are conducted here by setting values of "T1−t1", "T2−t2", "T3−t3", being differences between roll gaps T1, T2, T3 at respective places of the web corresponding part, the flange corresponding part, and the arm corresponding part, and thicknesses t1, t2, t3 of the finished material 19*a* at the respective places illustrated in FIG. 12, as allowance values of the roll gaps.

As illustrated in FIG. 10, when the allowance value of the roll gap during the bending forming is 0.5 mm or more, the change in load and torque is moderate, but when the allowance value of the roll gap is less than 0.5 mm, particularly less than 0.2 mm, an increase rate of load and torque becomes large, and the increase rate is significantly increased when the allowance value of the roll gap is 0 mm or less (namely, under thickness reduction). From this result, it can be understood that in order to suppress the forming load (load, torque) of the bending forming machine 20, it is preferable to set the allowance value of the roll gap to 0.5 mm or more by considering an actual thickness variation.

Further, as illustrated in FIG. 11, when the allowance value of the roll gap is 0.5 mm to 3 mm during the bending forming, the bending forming can be performed at a desired target angle (namely, about 124° 1° being a target angle between web and flange) almost all the times, but when the allowance value of the roll gap exceeds 3 mm, pressing by the caliber roll becomes small, the bending becomes weak, resulting in that the angle between web and flange tends to be larger than the target value. For this reason, it is sometimes required to perform large correction of the flange angle in a precise adjustment step after the bending forming. Specifically, in a final stand in particular, an upper limit of the allowance value of the roll gap is preferably set to 3 mm.

(Shape change in bending forming)

Figure 13:
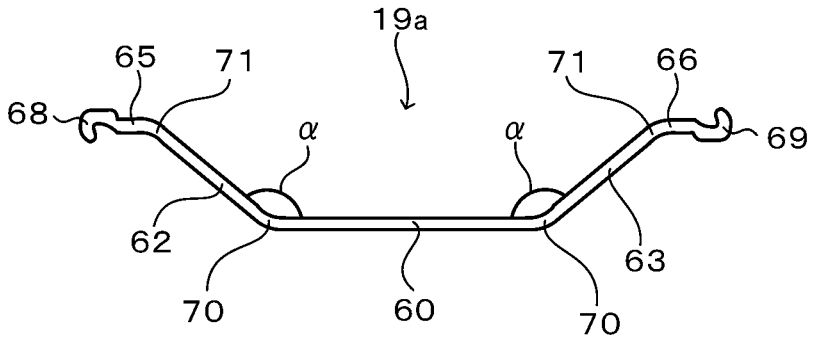
FIG. 13 are explanatory views regarding a shape change of a material to be rolled which is subjected to bending forming in a first stand and a second stand, in which FIG. 13(*a*) is a schematic sectional view before performing working in the first stand, FIG. 13(*b*) is a schematic sectional view at a time of performing working in the first stand, and FIG. 13(*c*) is a schematic sectional view at a time of performing working in the second stand.
Figure 13:
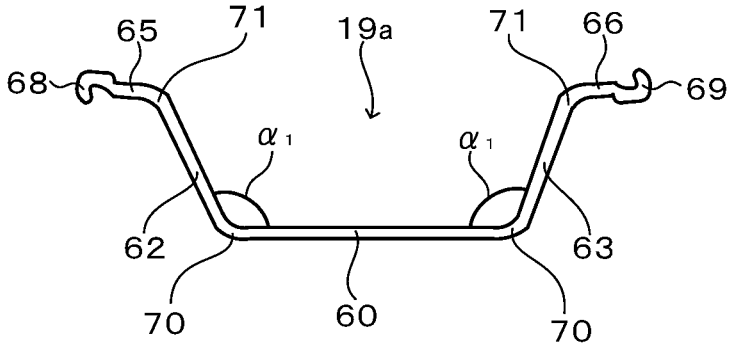
Figure 13:
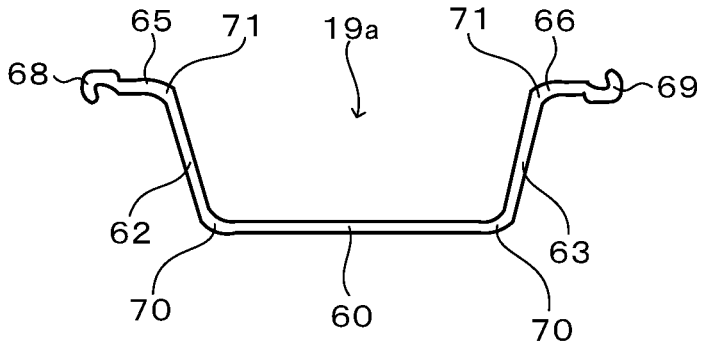

Subsequently, the forming of the material to be rolled in the stands 22, 23 described above will be explained. FIG. 13 are explanatory views regarding a shape change of the material to be rolled (the finished material 19*a*) which is subjected to the bending forming in the first stand 22 and the second stand 23, in which FIG. 13(*a*) is a schematic sectional view before performing working in the first stand 22, FIG. 13(*b*) is a schematic sectional view at a time of performing working in the first stand 22, and FIG. 13(*c*) is a schematic sectional view at a time of performing working in the second stand 23. As illustrated in FIG. 13(*a*), the finished material 19*a* has a substantially hat shape, and is composed of a substantially horizontal web corresponding part 60, flange corresponding parts 62, 63 connected to both ends of the web corresponding part 60 by corner parts 70 each having a predetermined angle (indicated as an angle α in the drawing) larger than that of a product shape, arm corresponding parts 65, 66 connected to end parts of the flange corresponding parts 62, 63 different from the sides thereof connected with the web corresponding part, via corner parts 71, and joint corresponding parts 68, 69 formed at tips of the arm corresponding parts 65, 66. Further, through the rolling in the finish rolling mill 19, a thickness of the finished material 19*a* is made to a substantially product thickness, and a shape of the joint corresponding parts 68, 69 is also made to a substantially product joint shape.

Here, a dimension of sheet thickness of the corner part 70 (also called a web-flange corner part 70, hereinafter) may be designed to be larger than a product sheet thickness. The web-flange corner part 70 can be rolled to a desired sheet thickness based on rolling conditions and rolling design in the hot rolling performed in the rough rolling mill 10, the first intermediate rolling mill 13, the second intermediate rolling mill 16, the finish rolling mill 19, and the like (refer to FIG. 1).

In like manner, a dimension of sheet thickness of the corner part 71 (also called a flange-arm corner part 71, hereinafter) may be designed to be larger than a product sheet thickness. The flange-arm corner part 71 can be rolled to a desired sheet thickness based on the rolling conditions and the rolling design in the hot rolling performed in the rough rolling mill 10, the first intermediate rolling mill 13, the second intermediate rolling mill 16, the finish rolling mill 19, and the like (refer to FIG. 1).

The finished material 19*a* illustrated in FIG. 13(*a*) is subjected to bending forming so that the angle α made by the web corresponding part 60 and each of the flange corresponding parts 62, 63 becomes small (the angle (becomes an angle $\alpha_1$ illustrated in FIG. 13(*b*)) in the caliber 45 of the first stand 22, resulting in that the finished material 19*a* has a height close to a desired product height as illustrated in FIG. 13(*b*). Specifically, in the first stand 22, the bending is performed so as to increase the height of the finished material 19*a*.

Next, as illustrated in FIG. 13(*c*), the finished material 19*a* is subjected to bending forming into a substantially product shape in the caliber 55 of the second stand 23.

(Contact Places in Bending Forming)

Figure 14:
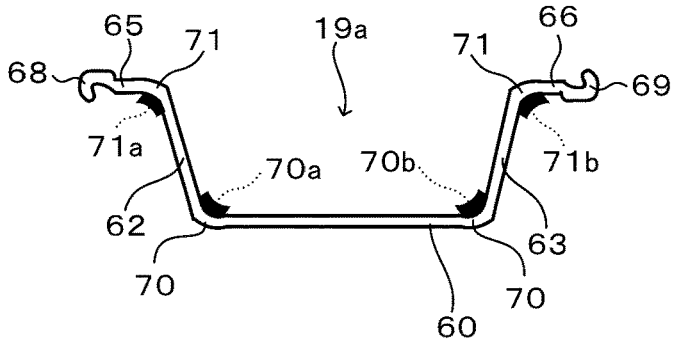
FIG. 14 are explanatory views regarding contact places of a finished material in a bending forming machine.
Figure 14:
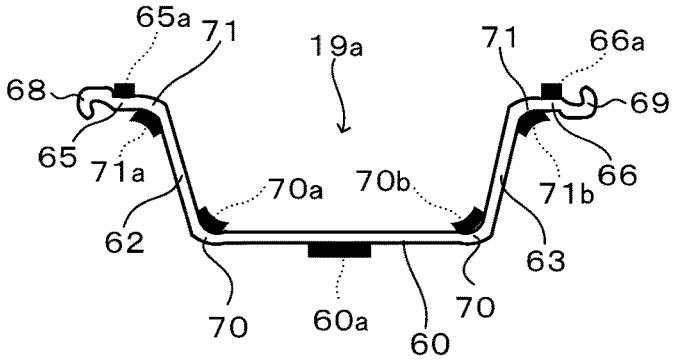
Figure 14:
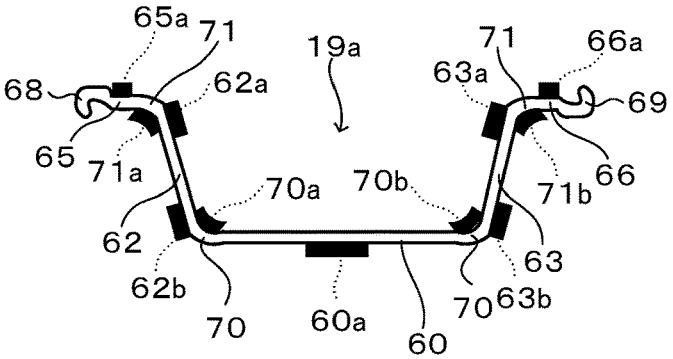
Figure 14:
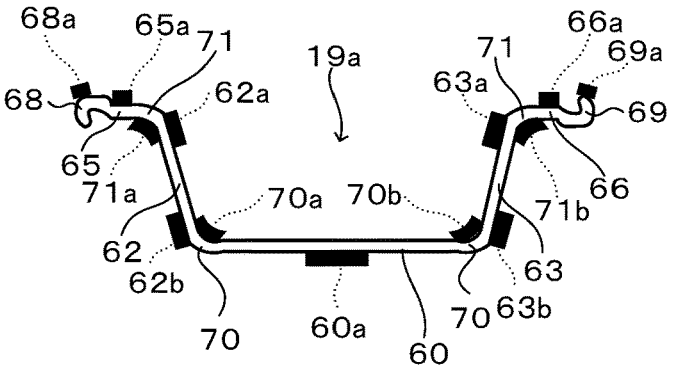

Further, FIG. 14 are explanatory views regarding contact places of the finished material 19*a* in the bending forming machine 20, and each of FIG. 14(*a*) to FIG. 14(*d*) illustrates one example contact places. Note that in FIGS. 14, the contact place is illustrated by a heavy line. In the caliber 45 of the first stand 22 and the caliber 55 of the second stand 23, each caliber roll and the finished material 19*a* are brought into contact only at part of predetermined places, and the reduction of sheet thickness is not performed. Concrete contact places between the caliber rolls and the finished material 19*a* are, as illustrated in FIG. 14(*a*), for example, inner sides of corner parts 70*a*, 70*b* at boundaries between the web corresponding part 60 and the flange corresponding parts 62, 63, and inner sides of corner parts 71*a*, 71*b* at boundaries between the flange corresponding parts 62, 63 and the arm corresponding parts 65, 66. Here, the "contact" is only required to mean a state where at least the material and the caliber roll are brought into contact, and it may also mean a state where force to press the material is further applied.

As illustrated in FIG. 14(*a*), 70*a*, 70*b* being the contact places are the inner sides of the corner parts 70 at the boundaries between the web corresponding part 60 and the flange corresponding parts 62, 63. On the other hand, 71*a*, 71*b* being the contact places are the inner sides of the corner parts 71 at the boundaries between the flange corresponding parts 62, 63, and the arm corresponding parts 65, 66. At 71*a* and 71*b* being the contact places, reaction forces occur in a direction balancing with reaction forces at 70*a*, 70*b*, respectively.

Here, by making a lower surface (outer surface) middle part 60*a* of the web corresponding part 60 illustrated in FIG. 14(*b*) to be brought into contact with a caliber roll facing the lower surface (outer surface) middle part 60*a*, bending of the corners made by the flange corresponding parts 62, 63 and the web corresponding part 60 can be efficiently performed. This is because, during the bending forming, the web corresponding part 60 tends to be warped downward in the drawing, so that by making the lower caliber roll to be brought into contact with the lower surface middle part 60*a* separated from both sides of the web corresponding part 60 (the corner parts 70), it is possible to effectively apply a bending moment to the both ends of the web corresponding part 60.

Further, in at least the second stand 23 being the final stand, in order to form substantially horizontal arm corresponding parts 65, 66, upper surfaces (outer surfaces) 65*a*, 66*a* of the arm corresponding parts 65, 66 become contact places. Besides, by properly setting the allowance value of the roll gaps as described above, in the caliber 45 of the first stand 22 and the caliber 55 of the second stand 23, it is desirable that inner upper portions 62*a*, 63*a* of the flange corresponding parts 62, 63 of the finished material 19*a* are brought into contact with the upper caliber rolls 40, 50, and outer lower portions 62*b*, 63*b* of the flange corresponding parts 62, 63 are brought into contact with the lower caliber rolls 41, 51, as illustrated in FIG. 14(*c*). By making the places illustrated in FIG. 14(*c*) to be brought into contact with the caliber rolls, three-point bending is performed on the corner parts 70, 71 based on the caliber roll shape, which makes it possible to perform the bending forming with high accuracy.

Further, as illustrated in FIG. 14(*d*), in addition to the places explained in FIG. 14(*a*) to FIG. 14(*c*), upper surfaces (outer surfaces) 68*a*, 69*a* of the joint corresponding parts 68, 69 may also be brought into contact with the upper caliber rolls 40, 50. By making the places illustrated in FIG. 14(*d*) to be brought into contact with the caliber rolls, it becomes possible to perform forming so that the joint corresponding parts 68, 69 also become substantially horizontal, and to perform bending forming with higher accuracy.

Figure 22:
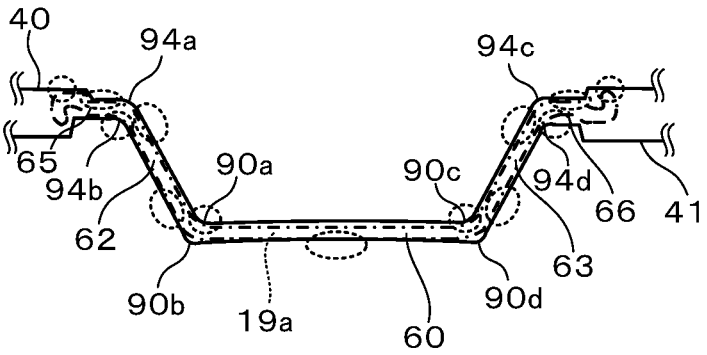
FIG. 22 is an explanatory view regarding a contact state with respect to caliber rolls.

Here, the contact state between the finished material 19*a* and the caliber rolls during the bending forming illustrated in FIG. 14(*d*), will be explained in more detail while referring to FIG. 22. In FIG. 22, the contact portions of the caliber rolls corresponding to the contact places of the finished material 19*a* in FIG. 14(*d*) are illustrated by being surrounded by a dotted line. At each of corner parts 90 (90*a* to 90*d*) of the upper caliber roll and the lower caliber roll facing the corner parts at the boundaries between the web corresponding part 60 and the flange corresponding parts 62, 63 of the finished material 19*a*, and at each of corner parts 94 (94*a* to 94*d*) of the upper caliber roll and the lower caliber roll facing the corner parts at the boundaries between the flange corresponding parts 62, 63 and the arm corresponding parts 65, 66, an r (curvature portion) is normally formed. With the inner sides of corner parts 70*a*, 70*b* at the boundaries between the web corresponding part 60 and the flange corresponding parts 62, 63 of the finished material 19*a*, the corner parts 90*a*, 90*c* of the upper caliber roll 40 (or 50) facing the inner sides of corner parts 70*a*, 70*b* are brought into contact. At that time, outer sides of corner parts at the boundaries between the web corresponding part 60 and the flange corresponding parts 62, 63, and the corner parts 90*b*, 90*d* of the lower caliber roll 41 (or 51) facing the outer sides of corner parts are not brought into contact. The lower caliber roll 41 (or 51) is brought into contact with the finished material 19*a* at a portion facing the lower surface (outer surface) middle part 60*a* of the web corresponding part 60 and portions facing the outer lower portions 62*b*, 63*b* of the flange corresponding parts 62, 63.

Further, with the inner sides of corner parts 71*a*, 71*b* at the boundaries between the flange corresponding parts 62, 63 and the arm corresponding parts 65, 66 of the finished material 19*a*, the corner parts 94*b*, 94*d* of the lower caliber roll 41 (or 51) facing the inner sides of corner parts 71*a*, 71*b* are brought into contact. At that time, outer sides of corner parts at the boundaries between the flange corresponding parts 62, 63 and the arm corresponding parts 65, 66, and the corner parts 94*a*, 94*c* of the upper caliber roll 40 (or 50) facing the outer sides of corner parts are not brought into contact. The upper caliber roll is brought into contact with the finished material 19*a* at portions facing the upper surfaces (outer surfaces) 65*a*, 66*a* of the arm corresponding parts 65, 66, and portions facing the inner upper portions 62*a*, 63*a* of the flange corresponding parts 62, 63. Further, the upper surfaces (outer surfaces) 68*a*, 69*a* of the joint corresponding parts 68, 69 are brought into contact with the upper caliber roll 40, 50 at portions facing the roll. Here, the contact state with respect to the upper and lower caliber rolls corresponding to FIG. 14(*d*) has been explained, but regarding FIG. 14(*a*) to FIG. 14(*c*) as well, it is only required that, with the contact places of the finished material 19*a*, the caliber rolls facing the contact places are brought into contact in a similar manner.

Note that the preferable contact places with respect to the finished material 19*a* in the bending forming have been explained with reference to FIG. 14(*a*) to FIG. 14(*d*), but a positional configuration of each place to be brought into contact in the bending forming is not one in which the sheet thickness of the finished material 19*a* is reduced, as illustrated in FIG. 14 and FIG. 22. Concretely, it is not configured such that a specific place of the finished material 19*a* is pressed (namely, subjected to reduction) from both sides by both upper and lower caliber rolls, and it is configured such that the roll gap between the upper and lower caliber rolls becomes larger than the sheet thickness of the finished material 19*a*, so that the reduction of the sheet thickness is not performed. If the web corresponding part 60 and the flange corresponding parts 62, 63 are not subjected to reduction, it is not required to unnecessarily increase reaction force in the reduction.

Further, in FIG. 14 and FIG. 22, the explanation has been made by illustration regarding one example of the configuration in which part of places of the respective caliber rolls are brought into contact with the respective corner parts 70, 71, but the contact places of the respective caliber rolls in the present invention are not limited to this. Specifically, it is also possible to provide additional contact parts, in addition to the contact places described above while referring to FIG. 14 and FIG. 22.

Figure 15:
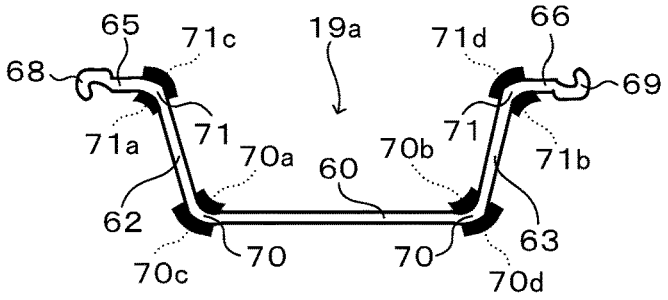
FIG. 15 are explanatory views regarding contact places in a bending forming machine.
Figure 15:
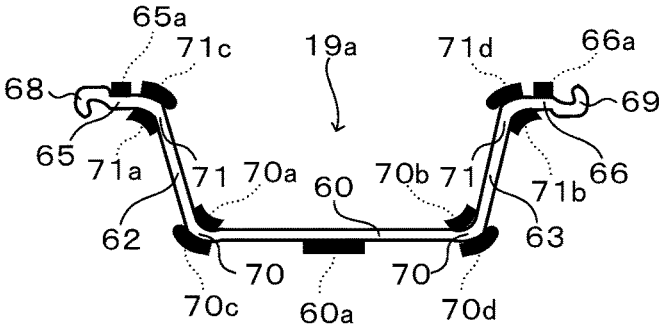
Figure 15:
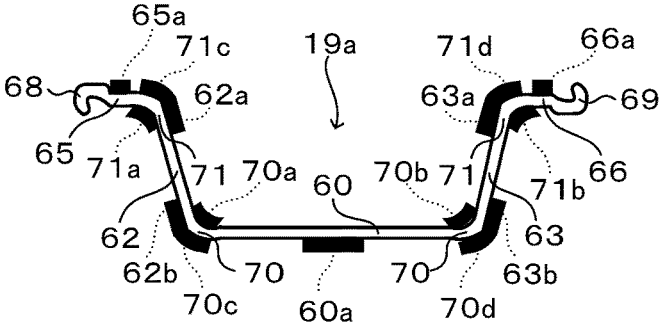
Figure 15:
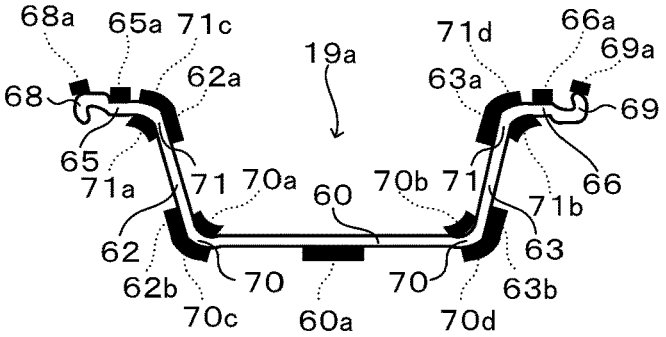

FIG. 15 are explanatory views regarding contact places of the finished material 19*a* in the bending forming machine 20, and each of FIG. 15(*a*) to FIG. 15(*d*) illustrates another example of the contact places. Here, the contact places same as those of FIG. 14 are denoted by the same codes, and explanation thereof will be omitted. As illustrated in FIGS. 15, as the contact places, it is also possible to provide, in addition to those illustrated in FIGS. 14, outer sides 70*c*, 70*d* of the corner parts 70 at the boundaries between the web corresponding part 60 and the flange corresponding parts 62, 63 (also called outer sides of web-flange corner parts 70*c*, 70*d*, hereinafter), and outer sides 71*c*, 71*d* of the corner parts 71 at the boundaries between the flange corresponding parts 62, 63 and the arm corresponding parts 65, 66 (also called outer sides of flange-arm corner parts 71*c*, 71*d*, hereinafter).

Specifically, when the contact places between the respective caliber rolls and the finished material 19*a* are set to the places illustrated in FIGS. 15, there is provided a positional configuration in which the web-flange corner parts 70 and the flange-arm corner parts 71 of the finished material 19*a* are brought into contact with both the upper and lower caliber rolls, and are subjected to reduction from both sides.

As described above, in the hot rolling (the rough rolling, the intermediate rolling, the finish rolling, and the like) being the steps on the upstream side of the bending forming, it is also possible that the finished material 19*a* is rolled so that the sheet thickness of each of the web-flange corner parts 70 and the flange-arm corner parts 71 becomes thicker than a product sheet thickness, and then is transferred to the bending forming machine 20. Further, the roll gaps between the upper and lower caliber rolls at portions facing the web-flange corner parts 70 and the flange-arm corner parts 71 of the finished material 19*a* may be set to the product sheet thickness. In such a dimensional configuration, in the finished material 19*a*, the web-flange corner parts 70 and the flange-arm corner parts 71 whose sheet thickness is in a state of being thicker than the product sheet thickness are subjected to reduction by both the upper and lower caliber rolls, and the whole material is subjected to bending forming in the bending forming machine 20.

As described above, the reduction is not performed in principle during the bending forming of the finished material 19*a*, but the reduction may be performed only on part of predetermined places (refer to FIG. 15). When the reduction is performed on the finished material 19*a*, the reduced region in its entire sheet thickness direction is subjected to plastic deformation. By the plastic deformation due to the reduction, a stress distribution within the sheet thickness due to bending shifts to a compression side as a whole, and the bending moment which acts on the corner parts becomes small. For this reason, in a range of being subjected to plastic deformation in the entire sheet thickness direction, springback after the bending forming becomes very small.

Specifically, as illustrated in FIGS. 15, when the bending forming is performed while performing reduction on the web-flange corner parts 70 and the flange-arm corner parts 71, when compared to a case where the reduction is not performed on the web-flange corner parts 70 and the flange-arm corner parts 71, a forming load is increased, but an increase in compressive stress on the inner sides in the thickness direction of the corner parts 70, 71 of the finished material 19*a* during the bending forming can be suppressed and at the same time, a tensile stress on the outer sides can be reduced, resulting in that the springback after the forming is reduced, and a variation in a dimensional shape in the longitudinal direction of the finished material 19*a* can be reduced. Consequently, it is possible to perform the rolling at an optimum shape without being restricted by a product shape (angle), and thus the productivity and the yield are improved. Further, a product with a large cross section excellent in dimensional accuracy can be produced at low cost without being restricted by a roll diameter of a rolling mill. Besides, a facility size can be reduced when compared to a case where cold working is performed, and a dimensional shape and material quality can be stabilized.

Note that in the bending forming in the configuration illustrated in FIGS. 15, if a reduction ratio of the web-flange corner parts 70 and the flange-arm corner parts 71 exceeds 20%, there is a possibility that a drawing balance at each part within a cross section is lost and the shape is collapsed. For this reason, the reduction ratio in the bending forming is preferably 20% or less, and more preferably 2 to 10%. If the reduction is performed up to 2%, the web-flange corner parts 70 and the flange-arm corner parts 71 in the entire sheet thickness direction become a plastic region, and it becomes possible to reduce the springback after the bending forming. However, it is required to adjust the sheet thickness of the web-flange corner parts 70 and the flange-arm corner parts 71 of the material to be rolled in the rolling step so that such a reduction ratio condition can be satisfied.

Further, when the bending forming machine 20 is configured by a plurality of stands, although the reduction may be performed on the corner parts 70, 71 in all of the stands, as long as the reduction is performed on the corner parts 70, 71 in at least a final stand (the second stand 23 in the present embodiment), it is possible to achieve the effect of reducing the springback after the forming.

Operation and Effect

According to the configuration explained above while referring to FIG. 14 and FIGS. 15, since the roll gaps in the respective upper and lower caliber rolls of the bending forming machine 20 are configured to be larger than the thicknesses of the flange corresponding parts and the web corresponding part of the finished material 19*a*, even in a case where a difference in thickness is generated between left and right flange corresponding parts of the material to be rolled due to a displacement in a thrust direction of the upper and lower caliber rolls in the rolling step (the rough rolling to the finish rolling), for example, it is possible to avoid a situation where only one of the flange corresponding parts is subjected to bending forming while the thickness reduction is performed thereon, and passage of material becomes unstable.

Further, as described above, the bending forming is performed in a hot state. It is preferable that the finish rolling mill 19 and the bending forming machine 20 are arranged in tandem, and the finish rolling and the bending forming are continuously performed in a hot state, because a reduction in temperature of the material to be rolled is suppressed. Here, the finish rolling and the bending forming in a hot state indicate rolling and forming at a temperature before completing transformation of the material to be rolled. By performing the bending forming under such a condition, when compared to conventional bending forming performed in a cold state, it is possible to reduce a forming load applied to the bending forming machine 20, material quality deterioration such as a reduction in elongation and toughness caused by the bending forming, and a residual stress.

As described above, the bending is performed as illustrated in FIGS. 13, whereby a hat-shaped steel sheet pile being a product is produced. In the bending forming machine 20, the finished material 19*a* is formed by using the caliber rolls, three-point bending moment occurs at the corner parts based on the caliber roll shape, and the corner parts are further bent to be close to the product shape. At this time, the respective caliber rolls are brought into contact with the finished material 19*a* only at the predetermined places illustrated in FIG. 14 or FIG. 15. Note that although the explanation has been made on the forming performed by the respective calibers 45, 55 with reference to FIG. 13(*a*) and FIG. 13(*c*), these processes of bending are continuously performed on one sheet of material (finished material 19*a*), and normally, the forming is performed in a state where one sheet of material is passed simultaneously through both the first stand 22 and the second stand 23 (namely, in a tandem state).

The production method for a steel sheet pile according to the present embodiment employs the configuration in which the bending forming is performed by using the bending forming machine 20 configured as described above, and thus it is possible to efficiently produce a hat-shaped steel sheet pile product without using a mill with large size and complicated mechanism or a large number of mills. Besides, the production method can be applied, with no problems, also to a case where a large-sized hat-shaped steel sheet pile product is produced.

Further, in the present embodiment, the bending forming machine 20 is provided directly behind the finish rolling mill 19, and the bending forming is performed in a hot state. Consequently, a temperature of the material to be rolled when entering the bending forming machine 20 can be kept to a high temperature, so that the rolling and the bending forming can be continuously performed without requiring the performance of reheating of the material to be rolled when performing the bending forming. According to the bending forming in a hot state, when compared to the bending forming in a cold state, the bending reaction force is small, the springback is also small, and the number of bending stages is also small.

One example of the embodiment of the present invention has been explained above, but the present invention is not limited to the illustrated embodiment. It should be understood that various changes and modifications are readily apparent to those skilled in the art within the scope of the spirit as set forth in claims, and those should also be covered by the technical scope of the present invention.

(Shape of Caliber Used for Intermediate Rolling)

For example, in the above-described embodiment, the bending in the bending forming machine 20 has been explained, but in the production of the hat-shaped steel sheet pile, there is room for improvement regarding a caliber shape and the like of the rolling mill other than the bending forming machine 20. Hereinafter, a preferable shape of the caliber used for the intermediate rolling will be explained.

According to the study of the present inventors, in an intermediate rolling step, even when the rolling is performed while balancing the drawing between the web corresponding part 60 and the flange corresponding parts 62, 63, the relative sliding speed between the material to be rolled (particularly, the flange corresponding parts 62, 63) and the roll differs depending on a part because the upper and lower caliber rolls are different in diameters of upper and lower rolls depending on a part. At the flange corresponding parts 62, 63, the elongation of the material to be rolled is suppressed by a peripheral speed difference between the upper and lower rolls at a part where the difference between upper and lower roll diameters is large, whereas the elongation is likely to occur at a position corresponding to a pitch line where the diameters of the upper and lower rolls are equal (hereinafter, described as a "neutral line"), so that a compressive stress is likely to occur in the longitudinal direction in the flange near the neutral line at a roll bite outlet and, in the case where the compressive stress exceeds a buckling limit, a defective shape so-called flange wave occurs at the flange corresponding parts 62, 63.

In particular, in the production of a large-sized steel sheet pile such as a hat-shaped steel sheet pile having a high ratio of flange width/flange thickness, the elongation of the flange near the neutral line tends to be large relative to the elongation of the web, and the compressive stress in the longitudinal direction acts on the middle parts of the flange corresponding parts 62, 63 from the inside of the roll bite. Further, the buckling limit stress also lowers, resulting in that the flange wave is remarkably likely to occur.

In the case of performing rolling in one pass by the same caliber, designing a caliber in a shape under consideration of the flange drawing and the web drawing according to the relation with the shape of the preceding caliber can suppress the flange wave. However, it was clarified that in the case of performing rolling in two or more passes by the same caliber, each drawing of the web corresponding part, the flange corresponding part, and the arm corresponding part is prescribed by the shape of the caliber in the rolling in the second and subsequent passes, so that it is impossible to suppress the occurrence of the flange wave in the middle of the reverse rolling even if the shape of the caliber is designed as in the prior art. For example, the result of study revealed that in the case where the reverse rolling is performed, the metal gathers at the middle parts (near the neutral line) of the flange corresponding parts 62, 63 every rolling at the flange corresponding parts 62, 63, and a phenomenon of restoration of the flange thickness is likely to occur. If the restoration of the thickness occurs, the flange drawing increases in the next pass and the flange wave undesirably becomes more likely to occur.

Besides, when comparing the first intermediate rolling mill 13 and the second intermediate rolling mill 16, the rolling mill at a subsequent stage rolls the material to be rolled (particularly, the flange corresponding parts 62, 63) thinner, and therefore is more likely to remarkably cause a defective shape such as the above-described occurrence of the flange wave. Further, if the defective shape occurs, a step closer to the finish rolling is more likely to be directly linked to the defective product shape. In other words, it is important to solve the problems as described above, in particular, in the rolling mill at a subsequent stage from the viewpoint of the product dimensional accuracy and the stability of rolling.

In view of the problems as described above, the present inventors earnestly studied about the shape of the caliber provided to the intermediate rolling mill, and arrived at the invention of the caliber shape satisfying predetermined conditions causing no defective shape called the flange wave. Hereinafter, the detailed shape of a caliber of the intermediate rolling mill configured to cause no flange wave will be explained while referring to the drawings. Note that although the rolling and shaping relating to, in particular, the flange corresponding part 63 in the second intermediate rolling mill 16, for example, will be illustrated and explained as an example in the following, the caliber to be a target is a caliber for performing thickness reduction on the whole material to be rolled, and is not limited to the caliber in the second intermediate rolling mill 16.

Figure 16:
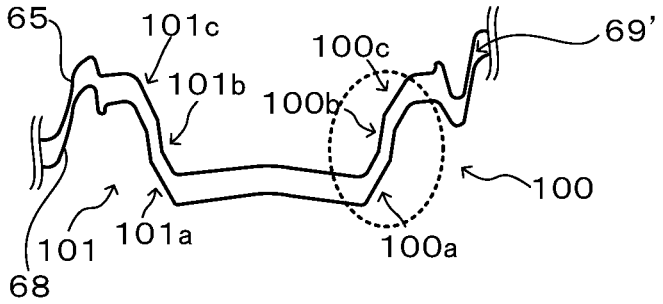
FIG. 16 are schematic explanatory views of one example of a configuration of a caliber provided to a second intermediate rolling mill.
Figure 16:
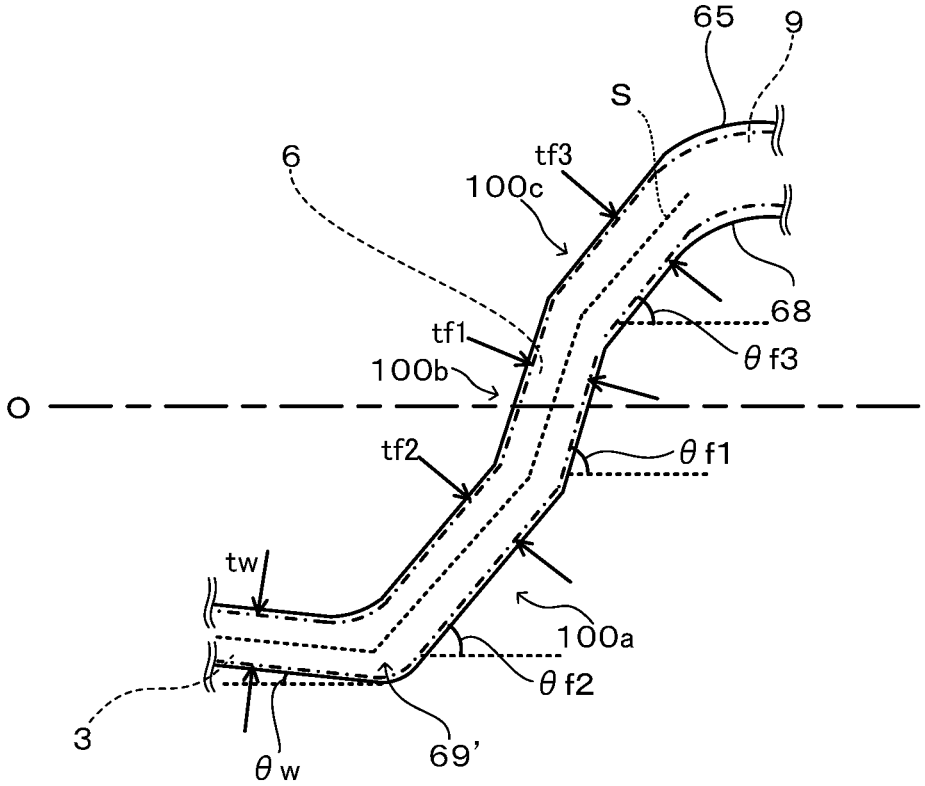

FIG. 16 are schematic explanatory views illustrating one example of a configuration of a caliber 80 provided to the second intermediate rolling mill 16, in which FIG. 16(*a*) illustrates a schematic entire view and FIG. 16(*b*) illustrates an enlarged view near a place facing the flange corresponding part 63 (a portion surrounded by a dotted line in FIG. 16(*a*)). Here, FIG. 16(*b*) illustrates an appearance after rolling in the caliber 80 and illustrates the rolled material to be rolled with a dot and dash line.

As illustrated in FIGS. 16, the caliber 80 is composed of an upper caliber roll 85 and a lower caliber roll 88. The caliber rolling in the caliber 80 composed of the upper caliber roll 85 and the lower caliber roll 88 performs the thickness reduction (namely, intermediate rolling) on the whole material to be rolled. Note that the rolling here is performed, for example, by reverse rolling in the same caliber 80.

Further, in the caliber 80 illustrated in FIGS. 16, a facing portion 100 facing the flange corresponding part 63 of the material to be rolled is composed of a plurality of flange facing portions 100*a*, 100*b*, 100*c* different in inclination in order from the side closer to the web. Regarding these flange facing portions 100*a*, 100*b*, 100*c*, the flange facing portion 100*b* is prescribed and called as a "first flange facing portion", and flange facing portions 100*a*, 100*c* arranged on both sides thereof are prescribed and called a "second flange facing portion" and a "third flange facing portion" respectively in some cases in this description. Further, a part of a flange corresponding part 6 rolled and shaped by the flange facing portion 100*b* positioned at the middle is prescribed and called a "first flange part", and parts of the flange corresponding part 6 arranged on both sides thereof (parts to be rolled and shaped by the flange facing portions 100*a*, 100*c*) are prescribed and called a "second flange part" and a "third flange part" respectively in some cases.

Note that as illustrated in FIG. 16(*a*), a portion 101 facing the flange corresponding part 62 of the material to be rolled is similarly composed of flange facing portions 101*a*, 101*b*, 101*c*.

Inclination angles of the flange facing portions 100*a*, 100*b*, 100*c* with respect to the horizontal line are θf2, θf1, θf3, respectively, and θf1 is an angle larger than θf2 and θf3. Besides, θf2 and θf3 may be an equal angle. When intervals tf2, tf1, tf3 (also called as roll gaps) between the upper caliber roll 85 and the lower caliber roll 88 in the flange facing portions 100*a*, 100*b*, 100*c* are constant (the flange facing portions 100*a*, 100*b*, 100*c* of the upper caliber roll 85 and the lower caliber roll 88 are parallel), the angles θf2, θf1, θf3 in each of the upper caliber roll 85 and the lower caliber roll 88 are equal. On the other hand, when the angles made between the flange facing portions 100*a*, 100*b*, 100*c* and the horizontal line are different between the upper caliber roll 85 and the lower caliber roll 88, it is only necessary to regard average values of the angles made between the flange facing portions of the upper caliber roll 85 and the lower caliber roll 88 and the horizontal line as the angles θf2, θf1, θf3. Further, the inclination angles θf2, θf1, θf3 are substantially the same even when prescribed as angles made between a center line S in the roll gap between the upper and lower caliber rolls and the horizontal line.

Further, the flange facing portion 100*b* is constituted at a position across a neutral line O in the height direction, the flange facing portion 100*a* is positioned on the side closer to the web than the flange facing portion 100*b*, and the flange facing portion 100*c* is positioned on the side closer to the arm (joint). In other words, the flange facing portion 100*b* is positioned across the neutral line O and the flange facing portions 100*a*, 100*c* are positioned on both sides thereof.

Here, when the drawing per pass is defined by the thickness ratio before rolling to the thickness after rolling (after one pass), the thickness is represented by the roll gap in the sheet thickness direction in the caliber 80, and a roll gap reduction amount in the vertical direction in one pass during reverse rolling in the caliber 80 is Δg, the drawings λf1, λf2, λf3 per pass of the flange facing portions 100*b*, 100*a*, 100*c* are expressed by following Expressions (1) to (3).

$$\lambda f1 = tf'1/tf1 = (tf1 + \Delta g \cdot \cos\theta f1)/tf1 \quad (1)$$

$$\lambda f2 = tf'2/tf2 = (tf2 + \Delta g \cdot \cos\theta f2)/tf2 \quad (2)$$

$$\lambda f3 = tf'3/tf3 = (tf3 + \Delta g \cdot \cos\theta f3)/tf3 \quad (3)$$

Note that tf'1, tf'2, tf'3 are roll gaps corresponding to the thickness before rolling of the flange corresponding part 63 corresponding to the flange facing portions 100*b*, 100*a*, 100*c* respectively in the caliber 80. Further, tf1, tf2, tf3 are roll gaps corresponding to the thickness of the flange corresponding part 63 rolled by the flange facing portions 100*b*, 100*a*, 100*c* respectively in the caliber 80.

Specifically, by making θf1 a larger angle than θf2 and θf3 based on the relation among tf1, tf2, tf3, the following Expressions (4), (5) are satisfied in rolling in the caliber 80.

$$\lambda f1 < \lambda f2 \quad (4)$$

$$\lambda f1 < \lambda f3 \quad (5)$$

Here, the above Expressions (1) to (3) express the drawings per pass of rolling, and the relations similar to Expressions (1) to (3) are established also in the case of totaling the drawings in the reverse rolling performed in a plurality passes. Accordingly, by making θf1 a larger angle than θf2 and θf3 in the caliber 80, the above Expressions (4), (5) are satisfied not only in the case of the drawings per pass but also in the case of totaling the drawings in a plurality passes during the reverse rolling.

The material to be rolled rolled and shaped in the caliber 80 becomes a bent shape having a plurality of inclination angles at the flange corresponding part 62, 63. This shape is made into a desired flat flange shape (flange shape of the hat-shaped steel sheet pile product) by the caliber at a stage subsequent to the caliber 80 provided to the intermediate rolling mill, for example, the caliber provided to the finish rolling mill 19 (finish rolling step) and the like. In the flange flattening, no reverse rolling is performed. Note that after the bending-back of the flange part, streaky traces in the longitudinal direction are sometimes found in the boundary portion of the bent part due to the difference in adherence state of scale with respect to other portions or the like, but the traces do not reduce the strength or the like of the flange part and do not affect the quality as the steel sheet pile.

According to the configuration of the caliber 80 as described above, making the angle θf1 large decreases the flange drawing near the neutral line O where the compressive stress is likely to occur relative to the caliber having the linear flange facing portion (also described as a conventional caliber, hereinafter) and decreases the flange drawing near the neutral line O relative to the flange drawing at a position separated from the neutral line O, to thereby realize the effect of suppressing the occurrence of the flange wave. On the other hand, making the angles θf2 and θf3 small suppresses the increase in flange height, to thereby maintain the drawing of the cross section of the flange corresponding part 6. For example, it is only necessary to make the line length of the center line S corresponding to the flange facing portions (100*a*, 100*b*, 100*c*) of the caliber 80 identical to the line length of the center line of the flange facing portions of the conventional caliber and design the angles θf2, θf3 in a manner not to change the position in the horizontal direction of the joint with respect to the angle θf1 decided as a flange wave suppression condition, in consideration of the suppression of variation in dimension when shaping into a desired flat flange shape by rolling by the caliber at a subsequent stage. Namely, if the reverse rolling is performed in the caliber 80, the flange drawing decreases as compared with the conventional caliber at the flange facing portion 100*b* but the flange drawing increases as compared with the conventional caliber at the flange facing portions 100*a*, 100*c*, and therefore the same flange cross section drawing as that in the conventional caliber can be maintained as the whole flange. Note that making the line length of the center line S corresponding to the flange facing portions (100*a*, 100*b*, 100*c*) of the caliber 80 identical to the line length of the center line of the flange facing portions of the conventional caliber does not mean being complete identical but may be being identical within a range of error (for example, less than ±1% with respect to the line length of the center line of the flange facing portion).

Here, to suppress the flange wave at the flange facing portion 100*b* (hereinafter, also called a steep inclination part 100*b*) near the neutral line O, it is preferable to set the angle θf1 so that the relation between the drawing λf1 of the flange at the steep inclination part 100*b* and a drawing kw of the web corresponding part 60 satisfies the following Expression (6).

$$\lambda f1 \leq \lambda w \tag{6}$$

Note that it is desirable to set λf1/λw per pass to fall within a range of 0.967≤λf1/λw≤1.000, as a more detailed condition.

Since the drawing of the flange is greatly affected by the drawing of the web, the drawing of the flange corresponding part near the neutral line O is expressed by the relation with the drawing of the web. In the case of the hat-shaped steel sheet pile, the drawing of the arm corresponding parts 65, 66 and the drawing of the web corresponding part 60 are considered to be substantially equal, and the drawing of the flange corresponding part near the neutral line O can be substantially expressed by the relation with the web drawing. The drawing λw of the web in one pass during reverse rolling is expressed by the following Expression (7).

$$\lambda w = tw'/tw = (tw + \Delta g \cdot \cos\theta w)/tw \tag{7}$$

Here, tw' is the roll gap corresponding to the thickness of the web corresponding part 60 before rolling in the caliber 80. Besides, tw is the roll gap corresponding to the thickness of the web corresponding part 60 rolled in the caliber 80. Besides, θw is the inclination angle of the roll gap corresponding to the web corresponding part 60 with respect to the horizontal line.

Further, in the case of the hat-shaped steel sheet pile having a constant thickness in the flange width direction, the caliber shape is designed so that each thickness of the flange facing portions 100*a*, 100*b*, 100*c* is constant in the final pass except for the error accompanying roll abrasion or the like in the caliber 80 directly before the finish rolling, but the inclination angle θf1 of the flange facing portion 100*b* is different from the inclination angles θf2, θf3 of the flange facing portions 100*a*, 100*c*, and therefore each thickness is not constant in midway passes in the caliber 80. For this reason, the inclination angle and the width of each flange facing portion may be decided in consideration of the drawing ratios λf1/λw, λf2/λw, λf3/λw in a pass where the flange wave is most likely to occur from the relation between the thickness and drawing of each flange facing portion and the drawing of the web corresponding part.

As explained above, making the inclination angle θf1 of the steep inclination part 100*b* large makes it possible to decrease the flange drawing near the neutral line O and reduce the compressive stress occurring at this portion.

Making the caliber shape of the caliber 80 with which the intermediate rolling is performed in the shape having the plurality of flange facing portions 100*a*, 100*b*, 100*c* different in inclination angle as explained above while referring to FIG. 16 and setting the inclination angles of the flange facing portions 100*a*, 100*b*, 100*c* to preferable conditions as expressed in the above Expressions (1) to (6) make it possible to reduce the compressive stress occurring near the neutral line O of the flange corresponding part 63 in the rolling and shaping in the caliber 80 and suppress the occurrence of the flange wave. Furthermore, it is also possible to reduce the restoration of the flange thickness occurring due to gathering of the metal near the neutral line of the flange corresponding part 63 in the reverse rolling to further suppress the occurrence of the flange wave.

On the other hand, the drawing of the flange occurring at the flange facing portions 100*a* and 100*c* increases relative to the drawing of the flange occurring near the neutral line O (namely, the drawing of the flange at the flange facing portion 100*b*) and the compressive stress occurring there also increases, but the compressive stress does not become excessive since metal flow to the web corresponding part 60 and the arm corresponding part 66 is likely to occur in addition to separation from the neutral line O. Further, parts, corresponding to the flange facing portions 100*a* and 100*c*, in the flange corresponding part 63 are connected to the web corresponding part 60 and the arm corresponding part 66 and unlikely to cause buckling, so that the flange wave is unlikely to occur at the parts.

As described above, making the caliber shape of the caliber 80 in the shape having the plurality of flange facing portions 100*a*, 100*b*, 100*c* different in inclination angle makes it possible to suppress the flange wave occurring near the neutral line O of the flange corresponding parts 62, 63 of the material to be rolled as compared with the rolling and shaping in the conventional caliber, thereby realizing the improvement of the product dimensional accuracy and the stability of rolling. Depending on the product shape, the drawing of the flange corresponding parts 62, 63 is larger than the drawing of the web corresponding part 60 in the rolling in the conventional caliber, so that the balance cannot be maintained any longer and the flange wave cannot be suppressed in some cases. In that case, not changing the inclination angle of the whole flange but making the inclination angle θf1 of the steep inclination part 100*b* larger than the flange inclination angle of the conventional caliber shape as illustrated in FIG. 16 and larger than the flange facing portions 100*a* and 100*c* makes it possible to suppress the increase in height of the material to be rolled during the rolling and shaping and effectively suppress the flange wave.

(Another Shape of Caliber Used for Intermediate Rolling)

Further, the caliber part facing the flange corresponding part 62, 63 of the material to be rolled (namely, the flange facing portion 100) may be, with respect to a straight line linking the boundary part on the arm side (of the material to be rolled) and the boundary part on the web side (of the material to be rolled), in a protruding shape in a flange inside direction on the side closer to the arm than the flange facing portion near the neutral line O and in a protruding shape in a flange outside direction on the side closer to the web than the flange facing portion near the neutral line O.

Concretely, regarding the shape of the flange facing portion 100 provided with the steep inclination part 100*b*, the shape of each of the flange facing portions 100*a* to 100*c* does not always need to be formed in the linear shape but, for example, part or all of the flange facing portions 100*a* to 100*c* may be formed by a curved line as long as the inclination angles of the flange facing portions 100*a*, 100*b*, 100*c* are made under the preferable conditions as expressed in the above Expressions (4) to (6). In this case, the steep inclination part 100*b* is defined as a range sandwiched between an intersection with the flange facing portion 100*a* and an intersection with the flange facing portion 100*c*, and the steep inclination part 100*b* is configured to cross the neutral line O.

Figure 17:
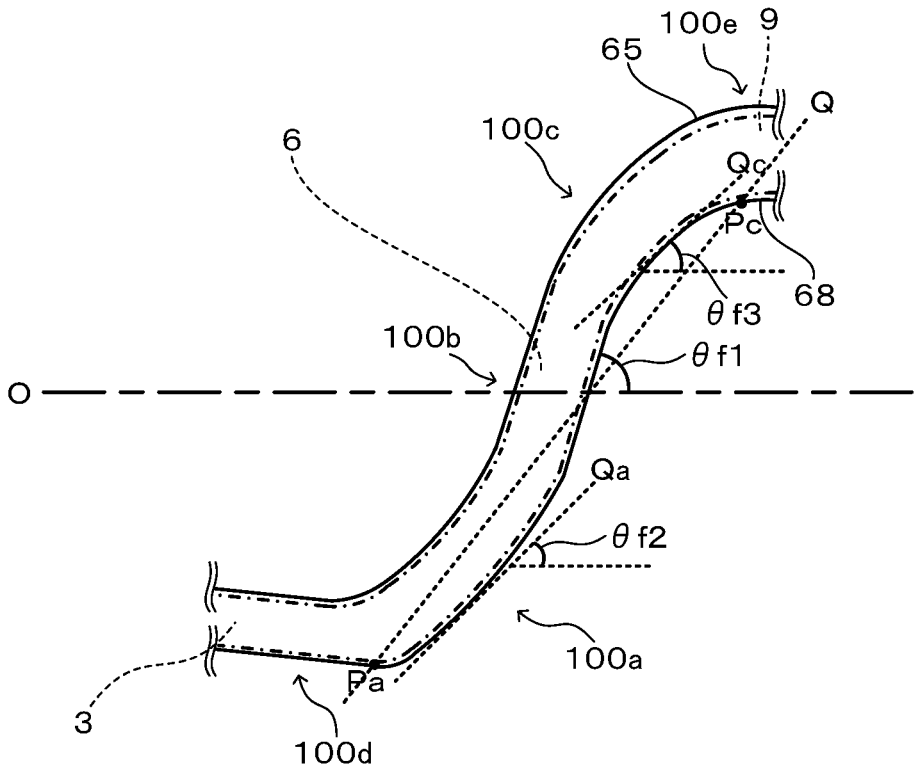
FIG. 17 is a schematic explanatory view according to another shape of a caliber used for intermediate rolling.

FIG. 17 is a schematic explanatory view according to another shape of the caliber used for the intermediate rolling, and is a schematic enlarged view illustrating an example of the vicinity of a place facing the flange corresponding part 63. As illustrated in FIG. 17, the flange facing portions 100*a*, 100*c* are formed in a curved shape. The step of performing the reverse rolling preferably includes a step of forming the web corresponding part 60 connected to the flange part including at least one second flange part (also referred to as a web-side flange part) and the arm corresponding part 66 connected to the flange part including at least one third flange part (also referred to as an arm-side flange part). In this case, the caliber preferably includes a web facing portion 100*d* for forming the web corresponding part 60 and an arm facing portion 100*e* for forming the arm corresponding part 66. Here, the caliber preferably includes a web-side flange facing portion group including at least one flange facing portion 100*a* (second flange facing portion) and an arm-side flange facing portion group including at least one flange facing portion 100*c* (third flange facing portion). Here, the boundary between the web-side flange facing portion group and the web facing portion 100*d* is assumed to be Pa, and the boundary between the arm-side flange facing portion group and the arm facing portion 100*e* is assumed to be Pc.

In the example illustrated in FIG. 17, with respect to a straight line Q linking the boundary part Pc on the arm side (the boundary between the arm facing portion 100*e* facing the arm corresponding part 66 and the flange facing portion 100*c*) and the boundary part Pa on the web side (the boundary between the web facing portion 100*d* facing the web corresponding part 60 and the flange facing portion 100*a*), the flange facing portion 100*a* is in a curved shape to be a protruding shape in a flange outside direction, and the flange facing portion 100*c* is in a curved shape to be a protruding shape in a flange inside direction. Further, the steep inclination part 100*b* is illustrated as a linear shape in the present modified example, but the steep inclination part 100*b* may be in a curved shape.

In the case where the flange facing portions 100*a*, 100*c* as illustrated in FIG. 17 are in a curved shape, the inclination angles θf2, θf3 of the flange facing portions 100*a*, 100*c* only need to be decided by the inclination angles of the tangents (Qa, Qc in FIG. 17) at the middle part in the height direction of the flange facing portions 100*a*, 100*c* with respect to the horizontal line. In the case where the steep inclination part 100*b* is in a curved shape, the inclination angle only needs to be decided based on the tangent where the angle becomes maximum. The straight line Q and the tangents Qa, Qc are explained using the lower caliber roll 88 in FIG. 17, and those only need to be similarly decided also in the upper caliber roll 85. Then, in the case where the angles made between the flange facing portions 100*a*, 100*b*, 100*c* and the horizontal line are different between the upper caliber roll 85 and the lower caliber roll 88, θf2, θf1, θf3 only need to be set to average values of the angles made between the flange facing portions of the upper caliber roll 85 and the lower caliber roll 88 and the horizontal line. By setting the inclination angles of the flange facing portions 100*a* to 100*c* defined as described above to the preferable conditions as expressed in the above Expressions (1) to (6), the same operation and effect can be obtained.

Specifically, in this case, the caliber shape of the caliber 80 is explained as a shape having the plurality of flange facing portions 100*a*, 100*b*, 100*c* different in inclination angle, but the detailed shapes of the portions 100*a*, 100*b*, 100*c* are not mentioned. The shape of the flange corresponding part 62, 63 only needs to be constituted by a plurality of straight lines or curved lines or combination of them, and the shapes of the portions 100*a*, 100*b*, 100*c* can be arbitrarily designed according to the shape of the flange corresponding part 62, 63. If the curved portion is constituted in the flange corresponding part 62, 63, the inclination angle of the curved portion only needs to be defined by the angle of its tangent.

(Production of Another Product with Size of Different Thickness)

The rolling line L described in the aforementioned embodiment is preferably configured to be able to deal also with a case of producing a product with different thickness. Also in the bending forming machine 20 on this rolling line L, it is preferable not to perform the sheet thickness reduction on the finished material 19*a*, similarly to the aforementioned embodiment. Namely, the rolling step (rough rolling to finish rolling) is performed to set a thickness of the finished material 19*a* to have a thickness dimension of the product, and then the finished material 19*a* is formed to have a cross-sectional shape close to that of the product, without performing the sheet thickness reduction on the finished material 19*a* by using the bending forming machine 20. In such a case, in the bending forming machine 20, the roll gaps in the caliber 45 and the caliber 55 are adjusted so as to respond to the change in thicknesses of the web corresponding part 60 and the flange corresponding parts 62, 63 of the finished material 19*a*.

Figure 18:
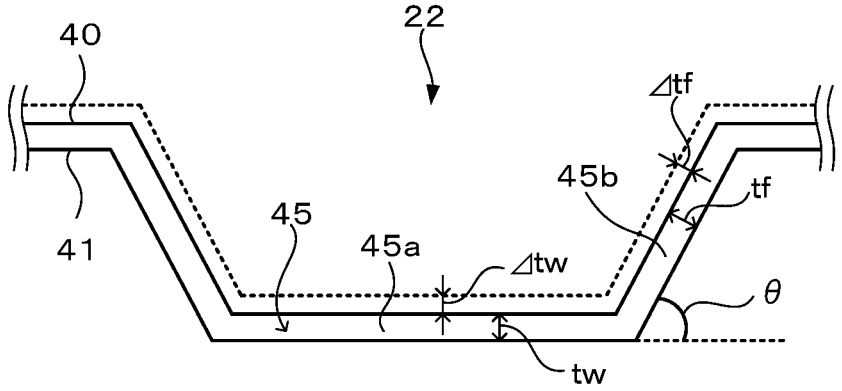
FIG. 18 is a schematic explanatory view in a case of varying roll gaps of a caliber.

Here, as illustrated in FIG. 18, for example, in the caliber 45, a roll gap at a portion 45*a* facing the web corresponding part 60 (referred to as a web portion 45*a*, hereinafter) is set to tw, a roll gap at a portion 45*b* facing the flange corresponding part 62, 63 (referred to as a flange portion 45*b*, hereinafter) is set to tf, and further, an angle of the flange portion 45*b* with respect to the web portion 45*a* (referred to as a flange angle, hereinafter) is set to θ. Further, when the roll gaps of the caliber 45 are increased by Δ in the vertical direction, the roll gap at the web portion 45*a* is increased by Δtw (=A), and the roll gap at the flange portion 45*b* is increased by Δtf (=Δcosθ), as indicated by a broken line in FIG. 18.

The flange angles of the calibers in the rolling mills (the rough rolling mill 10 to the finish rolling mill 19) in the rolling step and the flange angle θ in the bending forming machine 20 are different, so that even if the roll gaps in the rolling mills and the roll gaps in the bending forming machine 20 are adjusted by the same amount, the change amount Δtf of the flange portion 45*b* in these rolling mills and that in the bending forming machine 20 become different. Concretely, since the flange angle θ in the bending forming machine is larger than the flange angle in the finish rolling mill 19, the change amount Δtf in the bending forming machine 20 becomes smaller than the change amount Δtf in the finish rolling mill 19. Accordingly, there is a possibility that the reduction of sheet thickness of the finished material 19*a* occurs at the flange portion 45*b* in the bending forming machine 20. For this reason, there is a need to individually set the change amount of the roll gaps in the rolling mills and the change amount of the roll gaps in the bending forming machine 20, in accordance with the change in thickness of the product.

Namely, the change amount of the roll gaps in the rolling mills is set so that the thickness of the finished material 19*a* becomes the thickness dimension of the product.

On the other hand, the change amount of the rolls gaps in the bending forming machine 20 is set so as not to perform the sheet thickness reduction on the finished material 19*a* of all thicknesses capable of being assumed, when forming the finished material 19*a* by using the bending forming machine 20. In other words, the roll gaps in the bending forming machine 20 are set so as to be larger than all the thicknesses capable of being assumed, in response to the change in thickness of the finished material 19*a*. Concretely, when, in order not to perform the sheet thickness reduction on the finished material 19*a* at a reference part in the bending forming machine 20, for example, the web portion 45*a* of the caliber 45, the roll gap at the web portion 45*a* is set to be larger than the product thickness at that part by A (product thickness+A), the roll gap at the flange portion 45*b* is set to be larger than the product thickness at that part by B (product thickness+B) so that the finished material 19*a* is not subjected to the sheet thickness reduction also at the flange portion 45*b*. Each of A and B is larger than 0, preferably 5 mm or less, and more preferably 0.5 mm to 3 mm. Further, the upper caliber roll 40 and the lower caliber roll 41 that form the caliber 45 are designed so as to be able to set the aforementioned roll gaps.

Note that in the above explanation, the roll gap at the flange portion 45*b* is set to the product thickness+B, and at the arm portion facing the arm corresponding part 65, 66 in the caliber 45, the roll gap is set to the product thickness+C, in a similar manner. Similarly to A and B, C is larger than 0, preferably 5 mm or less, and more preferably 0.5 mm to 3 mm. In a case of the hat-shaped steel sheet pile, the web corresponding part and the arm corresponding part of the product are horizontal, so that A and C become substantially the same. Further, the roll gaps in the other caliber 55 are set through a method similar to that of the roll gaps in the caliber 45 described above.

According to this embodiment, the effect similar to that of the aforementioned embodiment can be achieved, and besides, by adjusting the roll gaps by using the upper and lower caliber rolls same as those of the bending forming machine 20, it is possible to produce the product with different thickness. Therefore, the degree of freedom regarding a producible product size can be improved.

(Others)

For example, in the above-described embodiment, the case where the bending forming machine 20 is configured by the first stand 22 and the second stand 23 has been illustrated and explained, but the present invention is not limited to this. For example, the bending forming machine 20 may be a single stand, or it may also be configured by a plurality of stands whose number is arbitrary. When the bending forming machine 20 is configured by the plurality of stands, the bending forming can be performed in each stand in a shared manner, so that the shape change of the joint corresponding parts 68, 69 caused by the bending forming can be reduced. Note that the number of stands is preferably decided based on a balance between the bending forming angle and the facility investment, and if the bending forming angle is about 20° to 30°, for example, two stands are preferable.

Further, in the bending forming machine 20 described in the aforementioned embodiment, it is preferable to supply a lubricating oil or the like to contact portions between the material to be rolled (finished material 19*a*) and the respective caliber rolls, to lubricate the contact portions. In particular, a lower surface of the web corresponding part 60 and upper surfaces of the arm corresponding parts 65, 66 are locally brought into contact with the caliber rolls, and thus the relative sliding speed at the surfaces is large. For this reason, scratches are likely to be generated at the region in the product after being subjected to bending forming. Therefore, there is a need to lubricate the contact portions between the lower surface of the web corresponding part 60 and the upper surfaces of the arm corresponding parts 65, 66, and the caliber rolls, in particular. By performing such lubrication, it becomes possible to produce a product having good quality with no scratches.

Further, in the embodiment and the modified example thereof described above, the explanation has been made by exemplifying the case of producing the hat-shaped steel sheet pile product in the posture of upward-opening (the arm corresponding parts are positioned on the upper side relative to the web corresponding part), but the present invention can be applied also to a case of performing production in the opposite posture, which is, a posture of downward-opening (the arm corresponding parts are positioned on the lower side relative to the web corresponding part). In that case, it is only required to regard that the directions of joints and the upper and lower caliber rolls are arranged oppositely.

EXAMPLES

Example 1

A case where a hat-shaped steel sheet pile was produced through the production method for a steel sheet pile according to the present invention in which the hot finish rolling was performed and the hot bending forming of 200 was successively performed by the bending forming machine configured by continuous two stands, and a case where a hat-shaped steel sheet pile was produced by performing bending forming by cold working using a plurality of support rolls made of flat rolls, as a prior art, were compared.

According to the production method for a steel sheet pile according to the present invention, after cutting the material to be rolled after being subjected to the bending forming into a product length, an angle made by a flange and a web was increased by about 0.5° at the maximum, due to springback. Further, an overall width difference in the product longitudinal direction at this time was about 4.5 mm.

On the other hand, according to the production method for a steel sheet pile according to the prior art, after cutting the material to be rolled after being subjected to the bending forming into a product length, an angle made by a flange and a web was increased by about 2.2° at the maximum, due to springback. Further, an overall width difference in the product longitudinal direction at this time was about 25 mm.

Example 2

As Example 2 of the present invention, in order to produce a first hat-shaped steel sheet pile product (steel sheet pile 1 in Table) having a web thickness of 15.0 mm, a flange thickness of 11.3 mm, and an arm thickness of 14.5 mm, and a second hat-shaped steel sheet pile product (steel sheet pile 2 in Table) having a web thickness of 17.0 mm, a flange thickness of 12.8 mm, and an arm thickness of 16.5 mm, by using the same bending forming rolls, bending forming was performed in a hot state by sharing the rolls of the finish rolling mill and the two-stand bending forming machine and by adjusting only the roll gaps under dimensional conditions listed in following Table 1, to thereby produce the products.

TABLE 1

| | | STEEL SHEET PILE 1 | STEEL SHEET PILE 2 |
|---|---|---|---|
| FINISH ROLLING MILL | GAP AT WEB (mm) | 15.0 | 17.0 |
| | GAP AT FLANGE (mm) | 11.3 | 12.8 |
| | GAP AT ARM (mm) | 14.5 | 16.5 |
| | GAP AT MIDDLE OF CORNER (mm) | 14.0 | 15.9 |
| | FLANGE ANGLE (°) | 40.0 | 40.0 |
| FIRST STAND | GAP AT WEB (mm) | 17.0 | 19.0 |
| | GAP AT FLANGE (mm) | 13.6 | 14.7 |
| | GAP AT ARM (mm) | 16.5 | 18.5 |
| | GAP AT MIDDLE OF CORNER (mm) | 16.1 | 17.9 |
| | FLANGE ANGLE (°) | 56.0 | 56.0 |
| SECOND STAND | GAP AT WEB (mm) | 17.0 | 19.0 |
| | GAP AT FLANGE (mm) | 14.1 | 14.8 |
| | GAP AT ARM (mm) | 16.5 | 18.5 |
| | GAP AT MIDDLE OF CORNER (mm) | 16.1 | 18.4 |
| | FLANGE ANGLE (°) | 69.0 | 69.0 |

As listed in Table 1, the bending forming was performed by increasing each roll gap in the first stand and the second stand of the bending forming machine by 1.9 mm to 2.8 mm relative to the thickness of the finished material (namely, the roll gap of the finish rolling mill). This made it possible to produce a good product through the forming roll gap adjustment with quite low forming load when compared to the forming load of the finish rolling.

Example 3

As Example 3 of the present invention, studies were conducted regarding a difference in finish temperature of a material to be rolled after intermediate rolling in an intermediate rolling method using two calibers according to a prior art and the intermediate rolling method performed in one-caliber multiple-passes according to the present invention. The following Table 2 is a table indicating rolling conditions in the intermediate rolling of the conventional method and the method of the present invention. Further, FIG. 19 are explanatory views regarding the present Example 3, in which FIG. 19(*a*) illustrates a caliber arrangement of the conventional method, and FIG. 19(*b*) illustrates a caliber arrangement of the method of the present invention.

TABLE 2

| | CONVENTIONAL METHOD | PRESENT INVENTION |
|---|---|---|
| NUMBER OF CALIBER (INTERMEDIATE SHAPING) | TWO CALIBERS | ONE CALIBER |
| NUMBER OF PASS (INTERMEDIATE SHAPING) | FOUR PASSES | FOUR PASSES |
| FLANGE FINISH TEMPERATURE | 680° C. | 720° C. |

Figure 19:
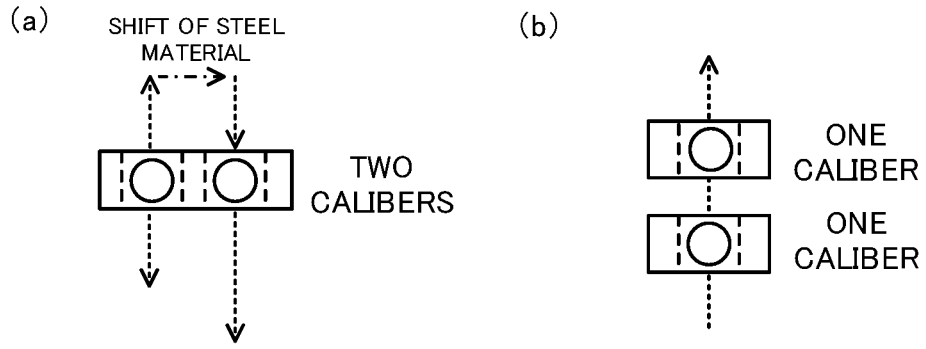
FIG. 19 are explanatory views regarding Example 3.
Figure 20:
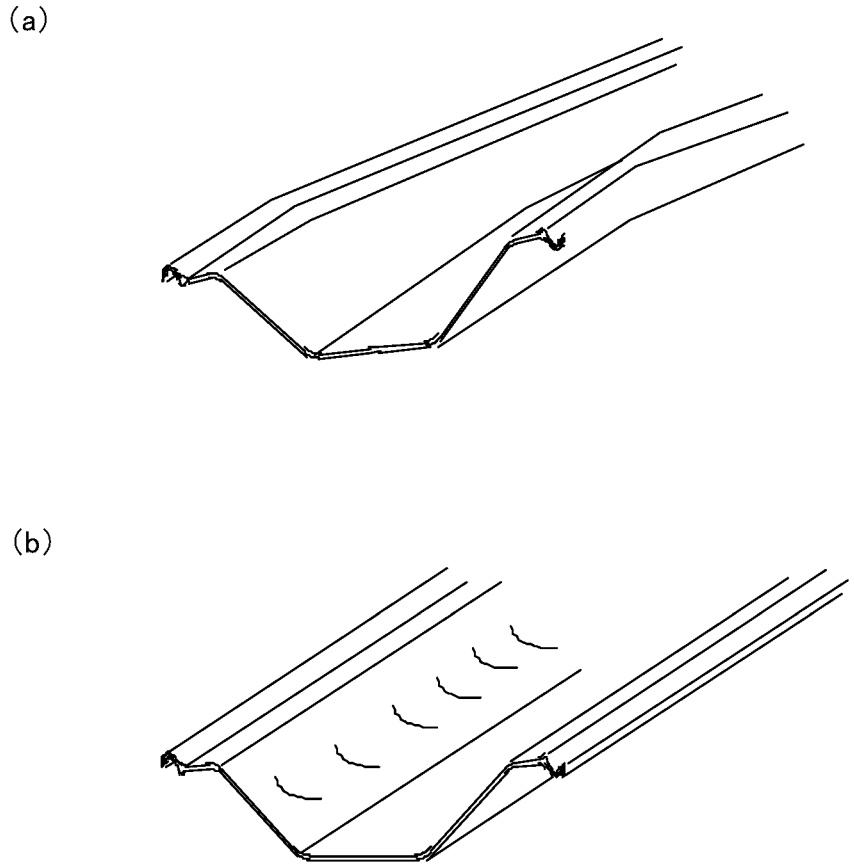
FIG. 20(*a*) and FIG. 20(*b*) are explanatory views illustrating a state of twist and a state of flange wave, respectively, which occur when caliber multiple-pass rolling of a hat-shaped steel sheet pile is performed under inappropriate conditions.
Figure 21:
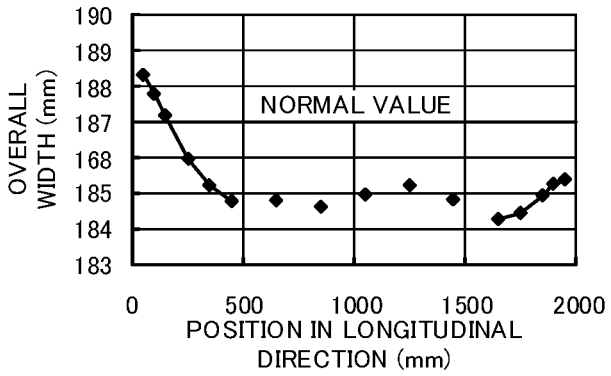
FIG. 21 is an explanatory view regarding a shape change in bending forming in cold working.

As illustrated in FIG. 19(*a*) and Table 2, in the conventional method, the rolling in two passes was performed in each of the two calibers, separately, which were arranged in a parallel manner. On the other hand, as illustrated in FIG. 19(*b*) and Table 2, in the method of the present invention, one caliber and one caliber were arranged in series, to perform the multiple-pass rolling. As a result of this, as listed in Table 2, it was confirmed that in the conventional method, it takes time to shift the steel material, but in the method of the present invention, since there is no need to shift the steel material, the flange finish temperature is higher by 40° C.

Note that when the present invention is employed, a roll barrel length becomes short, which provides an effect of improving a roll withstand load. In the production of a hat-shaped steel sheet pile, in a size with thin thickness and a large number of passes, in particular, a reduction amount per pass can be increased, and thus it is possible to expect an effect of reducing a large number of passes. In that case, the flange finish temperature can be improved further greatly than that listed in Table 2.

When the finish temperature of the steel material (material to be rolled) in the intermediate rolling is high, there are advantages that working energy is small, and saw-cutting of the steel material can be efficiently performed. Further, when performing the bending forming explained in the aforementioned embodiment, it is possible to reduce the forming load applied to the bending forming machine, the material quality deterioration such as the reduction in elongation and toughness caused by the bending forming, and the residual stress.

INDUSTRIAL APPLICABILITY

The present invention is applicable to a production method for a hat-shaped steel sheet pile.

EXPLANATION OF CODES

10 . . . rough rolling mill
13 . . . first intermediate rolling mill
14 . . . edger rolling mill
16 . . . second intermediate rolling mill
17 . . . edger rolling mill
19 . . . finish rolling mill
19*a* . . . finished material
20 . . . bending forming machine
22 . . . first stand
23 . . . second stand
40 . . . upper caliber roll
41 . . . lower caliber roll
44 . . . casing
45 . . . caliber
50 . . . upper caliber roll
51 . . . lower caliber roll
54 . . . casing
55 . . . caliber
60 . . . web corresponding part
62, 63 . . . flange corresponding part
65, 66 . . . arm corresponding part
68, 69 . . . joint corresponding part
70 . . . corner part
70*a*, 70*b* . . . inner side of corner part
70*c*, 70*d* . . . outer side of corner part
71 . . . corner part
71*a*, 71*b* . . . inner side of corner part
71*c*, 71*d* . . . outer side of corner part
80 . . . caliber (which performs intermediate rolling)
100 . . . facing portion
100*a* to 100*c* . . . flange facing portion
101*a* to 101*c* . . . flange facing portion L . . . rolling line O . . . neutral line

What is claimed is:

1. A production method for a hat-shaped steel sheet pile, comprising:

performing rough rolling on a material to be rolled through hot rolling, performing intermediate rolling on the material to be rolled through hot rolling, performing finish rolling on the material to be rolled through hot rolling, and after performing the rough rolling, the intermediate rolling, and the finish rolling, then performing bending forming, wherein the material to be rolled is composed of a web corresponding part, flange corresponding parts, arm corresponding parts, and joint corresponding parts;

wherein corner parts as worked parts are formed at connection places between the web corresponding part and the flange corresponding parts and connection places between the flange corresponding parts and the arm corresponding parts;

wherein the intermediate rolling is carried out by performing rolling in a plurality of passes on the material to be rolled in a hot state by using a caliber provided to upper and lower caliber rolls in one or a plurality of intermediate rolling mills in which one stand is configured by one caliber, at a height lower than a predetermined target product height; and wherein the bending forming is performed in a hot state and performed in a state where the worked parts have a temperature of transformation point or higher, and in the bending forming, the material to be rolled is formed to have predetermined target height and target width.

2. The production method for a hat-shaped steel sheet pile according to claim 1, wherein the intermediate rolling comprises a step of performing reverse rolling on the material to be rolled by a same caliber, wherein:

the step of performing reverse rolling comprises a step of forming first flange parts across a neutral line and second and third flange parts arranged on both sides of the first flange parts;

a caliber that performs the reverse rolling comprises first flange facing portions for forming the first flange parts, second flange facing portions for forming the second flange parts, and third flange facing portions for forming the third flange parts; and an inclination angle of the first flange facing portion with respect to a horizontal plane is larger than inclination angles of the second and third flange facing portions.

3. The production method for a hat-shaped steel sheet pile according to claim 2, wherein:

the step of performing reverse rolling comprises a step of forming the web corresponding part and the arm corresponding parts;

the caliber that performs the reverse rolling comprises a web facing portion for forming the web corresponding part and arm facing portions for forming the arm corresponding parts;

the caliber that performs the reverse rolling comprises web-side flange facing portion groups each including at least one of the second flange facing portions and arm-side flange facing portion groups each including at least one of the third flange facing portions; and with respect to a straight line linking a boundary part between the web-side flange facing portion group and the web facing portion and a boundary part between the arm-side flange facing portion group and the arm facing portion, the second flange facing portion is in a protruding shape in a flange outside direction, and the third flange facing portion is in a protruding shape in a flange inside direction.

4. The production method for a hat-shaped steel sheet pile according to claim 2, wherein in the caliber that performs the reverse rolling, rolling is performed in which flange drawing λf1 at one first flange part of the first flange parts is smaller than flange drawings λf2, λf3 at one second flange part of the second flange parts and one third flange part of the third flange parts, the one first flange part being adjacent to the one second flange part and the one third flange part.

5. The production method for a hat-shaped steel sheet pile according to claim 3, wherein in the caliber that performs the reverse rolling, rolling is performed in which flange drawing λf1 at one first flange part of the first flange parts is smaller than flange drawings λf2, λf3 at one second flange part of the second flange parts and one third flange part of the third flange parts, the one first flange part being adjacent to the one second flange part and the one third flange part.

6. The production method for a hat-shaped steel sheet pile according to claim 1, wherein:

the bending forming is performed by using upper and lower caliber rolls; and in the bending forming, the upper and lower caliber rolls are used, and parts of the upper and lower caliber rolls are brought into contact with inner sides of the corner parts to bend the corner parts.

7. The production method for a hat-shaped steel sheet pile according to claim 2, wherein:

the bending forming is performed by using upper and lower caliber rolls; and in the bending forming, the upper and lower caliber rolls are used, and parts of the upper and lower caliber rolls are brought into contact with inner sides of the corner parts to bend the corner parts.

8. The production method for a hat-shaped steel sheet pile according to claim 3, wherein:

the bending forming is performed by using upper and lower caliber rolls; and in the bending forming, the upper and lower caliber rolls are used, and parts of the upper and lower caliber rolls are brought into contact with inner sides of the corner parts to bend the corner parts.

9. The production method for a hat-shaped steel sheet pile according to claim 5, wherein:

the bending forming is performed by using upper and lower caliber rolls; and in the bending forming, the upper and lower caliber rolls are used, and parts of the upper and lower caliber rolls are brought into contact with inner sides of the corner parts to bend the corner parts.

10. The production method for a hat-shaped steel sheet pile according to claim 1, wherein in the bending forming, the forming is performed by making the rolls to be brought into contact with the corner parts in a manner that in a direction balancing with force applied to the corner parts, each being one corner part, which are connection parts between the web corresponding part and the flange corresponding parts due to the contact with respect to the roll, force is applied to the corner parts, each being the other corner part, which are connection parts between the flange corresponding parts and the arm corresponding parts.

11. The production method for a hat-shaped steel sheet pile according to claim 2, wherein in the bending forming, the forming is performed by making the rolls to be brought into contact with the corner parts in a manner that in a direction balancing with force applied to the corner parts, each being one corner part, which are connection parts between the web corresponding part and the flange corresponding parts due to the contact with respect to the roll, force is applied to the corner parts, each being the other corner part, which are connection parts between the flange corresponding parts and the arm corresponding parts.

12. The production method for a hat-shaped steel sheet pile according to claim 3, wherein in the bending forming, the forming is performed by making the rolls to be brought into contact with the corner parts in a manner that in a direction balancing with force applied to the corner parts, each being one corner part, which are connection parts between the web corresponding part and the flange corresponding parts due to the contact with respect to the roll, force is applied to the corner parts, each being the other corner part, which are connection parts between the flange corresponding parts and the arm corresponding parts.

13. The production method for a hat-shaped steel sheet pile according to claim 7, wherein in the bending forming, the forming is performed by making the rolls to be brought into contact with the corner parts in a manner that in a direction balancing with force applied to the corner parts, each being one corner part, which are connection parts between the web corresponding part and the flange corresponding parts due to the contact with respect to the roll, force is applied to the corner parts, each being the other corner part, which are connection parts between the flange corresponding parts and the arm corresponding parts.

14. The production method for a hat-shaped steel sheet pile according to claim 8, wherein in the bending forming, the forming is performed by making the rolls to be brought into contact with the corner parts in a manner that in a direction balancing with force applied to the corner parts, each being one corner part, which are connection parts between the web corresponding part and the flange corresponding parts due to the contact with respect to the roll, force is applied to the corner parts, each being the other corner part, which are connection parts between the flange corresponding parts and the arm corresponding parts.

15. The production method for a hat-shaped steel sheet pile according to claim 9, wherein in the bending forming, the forming is performed by making the rolls to be brought into contact with the corner parts in a manner that in a direction balancing with force applied to the corner parts, each being one corner part, which are connection parts between the web corresponding part and the flange corresponding parts due to the contact with respect to the roll, force is applied to the corner parts, each being the other corner part, which are connection parts between the flange corresponding parts and the arm corresponding parts.

16. The production method for a hat-shaped steel sheet pile according to claim 1, wherein:

the bending forming is performed by using upper and lower caliber rolls;

in the bending forming, the upper and lower caliber rolls are used, and parts of the upper and lower caliber rolls are brought into contact with inner sides of the corner parts in a hot state to bend the corner parts; and when performing the bending forming, roll gaps at portions, of the upper and lower caliber rolls, facing the web corresponding part, the flange corresponding parts, and the arm corresponding parts, are larger than thicknesses of the web corresponding part, the flange corresponding parts, and the arm corresponding parts, respectively.

17. The production method for a hat-shaped steel sheet pile according to claim 16, wherein in response to a change in thicknesses of the web corresponding part and the flange corresponding parts, the roll gaps at the portions, of the upper and lower caliber rolls that perform the bending forming, facing the web corresponding part and the flange corresponding parts, are respectively set to be larger than respective thicknesses.

18. The production method for a hat-shaped steel sheet pile according to claim 16, wherein:

in the hot rolling, the material to be rolled is rolled to make a sheet thickness of the corner parts to be larger than a product sheet thickness; and in the bending forming, the corner parts are subjected to reduction by the upper and lower caliber rolls.

19. The production method for a hat-shaped steel sheet pile according to claim 16, wherein in the bending forming, contact portions between the material to be rolled and the upper and lower caliber rolls are lubricated.

20. The production method for a hat-shaped steel sheet pile according to claim 16, wherein in the bending forming, the upper and lower caliber rolls are brought into contact with an outer side of the web corresponding part and outer surfaces of the arm corresponding parts.

21. The production method for a hat-shaped steel sheet pile according to claim 16, wherein in the bending forming, the upper and lower caliber rolls are brought into contact with outer surfaces of the joint corresponding parts to make the joint corresponding parts to be substantially horizontal.

22. The production method for a hat-shaped steel sheet pile according to claim 1, wherein a bending forming machine that performs the bending forming and a finish rolling mill that performs the finish rolling are arranged in tandem.

23. The production method for a hat-shaped steel sheet pile according to claim 1, wherein the worked parts are the connection places between the web corresponding part and the flange corresponding parts and the connection places between the flange corresponding parts and the arm corresponding parts, and are bent parts having a curvature.

* * * * *